US009961947B2

(12) United States Patent
Cockram

(10) Patent No.: US 9,961,947 B2
(45) Date of Patent: May 8, 2018

(54) ACTIVEWEAR WITH WAISTBAND POCKET

(71) Applicant: Leigh Cockram, Collinsville, VA (US)

(72) Inventor: Leigh Cockram, Collinsville, VA (US)

( * ) Notice: Subject to any disclaimer, the term of this patent is extended or adjusted under 35 U.S.C. 154(b) by 379 days.

(21) Appl. No.: 14/729,607

(22) Filed: Jun. 3, 2015

(65) Prior Publication Data

US 2015/0257459 A1 Sep. 17, 2015

Related U.S. Application Data

(63) Continuation-in-part of application No. 14/667,843, filed on Mar. 25, 2015, which is a continuation of
(Continued)

(51) Int. Cl.
*A41D 1/08* (2006.01)
*A41D 1/06* (2006.01)
(Continued)

(52) U.S. Cl.
CPC ..... *A41D 1/08* (2013.01); *A41D 1/002* (2013.01); *A41D 1/06* (2013.01); *A41D 1/14* (2013.01);
(Continued)

(58) Field of Classification Search
CPC .... A41D 27/20; A41D 27/204; A41D 27/205; A41D 1/06; A41D 1/08; A41D 10/00; A41D 13/1254; A41D 2300/00; A41D 1/067; A41D 1/14; A41D 27/00; A41D 27/201; A41D 2200/00; A41D 1/002;
(Continued)

(56) References Cited

U.S. PATENT DOCUMENTS 1,196,324 A 8/1916 Atkins
1,478,497 A 12/1923 Winslow
(Continued)

FOREIGN PATENT DOCUMENTS

AU 2012254915 6/2013
WO 1992022463 A1 12/1992

OTHER PUBLICATIONS

Co-Pending U.S. Appl. No. 13/933,817, filed Jul. 2, 2013, Published as US 2015/0007379 on Jan. 8, 2015, and Issued as U.S. Pat. No. 9,021,615 on May 5, 2015, File History, 352 pages.
(Continued)

*Primary Examiner* — Amy Vanatta
(74) *Attorney, Agent, or Firm* — New River Valley IP Law, PC; Michele L. Mayberry

(57) ABSTRACT

Provided is activewear with one or more waistband pockets. More particularly, athletic garments such as pants comprising one or more waistband pocket are included. The athletic garments include a body portion comprising fabric with an upper edge terminating as a 360° waistline and waistband composed of at least four pieces of fabric. A first and second piece of fabric define a first pocket on the waistband and a third and fourth piece of fabric define a second pocket on the waistband. Further, 360° of the waistline is attached to a bottom edge of the waistband. The first pocket and second pocket each include at least one opening to provide access to that pocket. Additionally, waistbands composed of at least six pieces of fabric are described as well as methods of manufacturing waistbands.

12 Claims, 27 Drawing Sheets

Related U.S. Application Data application No. 13/933,817, filed on Jul. 2, 2013, now Pat. No. 9,021,615, application No. 14/729,607, which is a continuation-in-part of application No. 29/509,555, filed on Nov. 19, 2014, now Pat. No. Des. 754,948.

(51) Int. Cl.

| | |
|---|---|
| ***A41D 27/20*** | (2006.01) |
| ***A41D 1/00*** | (2018.01) |
| ***A41D 1/14*** | (2006.01) |
| ***A41D 13/00*** | (2006.01) |

(52) U.S. Cl.

CPC ..... *A41D 13/0015* (2013.01); *A41D 27/20* (2013.01); *A41D 27/205* (2013.01)

(58) Field of Classification Search

CPC ..... A41D 13/0015; A41D 27/208; A41F 9/00; A41B 9/14

USPC ..... 2/235, 236, 237, 219, 220, 221, 83, 247

See application file for complete search history.

(56) References Cited

U.S. PATENT DOCUMENTS 1,506,255 A 8/1924 Rosenstein
1,559,764 A 11/1925 Navy
1,596,533 A 8/1926 Haubenstock
1,614,965 A * 1/1927 Margolith ..... A41F 9/00 2/236
1,654,433 A 12/1927 Ramirez
1,776,614 A * 9/1930 Bauer ..... A41F 9/025 2/236
1,792,117 A 2/1931 Paull
1,920,061 A 7/1933 Carr
1,930,049 A * 10/1933 Heller ..... A41F 9/02 2/236
1,946,173 A 2/1934 Miller
1,948,444 A 2/1934 Krein
2,055,858 A * 9/1936 Daniel ..... A41D 7/005 2/236
2,165,081 A 7/1939 Wald
2,197,584 A 4/1940 Latter
2,320,783 A 6/1943 Lee
2,351,158 A 6/1944 Stelzer
2,359,012 A 9/1944 Sophier
2,489,148 A 11/1949 Ludwig
2,492,862 A 12/1949 Etta
2,519,126 A 8/1950 Irving
2,537,701 A 1/1951 Previdi
2,544,840 A 3/1951 Kowatsch
2,551,907 A 5/1951 Dorothy
2,725,573 A 12/1955 Max
2,799,022 A 7/1957 Parise
2,854,670 A 10/1958 Naccash
2,865,025 A 12/1958 Hennessey
2,930,046 A 3/1960 Sagner
3,042,932 A 7/1962 Eppy
3,137,862 A 6/1964 Mizerak
3,174,482 A 3/1965 Warley
3,187,346 A 6/1965 Jacobson
3,414,907 A 12/1968 Flame
4,006,494 A 2/1977 Knoppel
4,079,871 A 3/1978 Sica
4,149,272 A 4/1979 Maeshima
4,277,847 A 7/1981 Florio
4,428,080 A 1/1984 Takamatsu
4,464,798 A 8/1984 Livingstone
4,498,200 A 2/1985 Livingstone
4,523,703 A 6/1985 McKenna
D283,077 S 3/1986 Crandall
4,601,418 A 7/1986 Gruzensky
4,620,326 A 11/1986 Matthias
4,633,527 A 1/1987 Ehring
4,634,031 A 1/1987 Frankhouse
4,688,271 A 8/1987 Capelle
4,852,188 A 8/1989 Marsh et al.
4,888,006 A 12/1989 Beaupied
4,894,867 A 1/1990 Ceravolo et al.
4,976,653 A 12/1990 White
5,050,244 A 9/1991 Kleinman
5,255,392 A 10/1993 Stanislaw
D341,470 S 11/1993 Quick
5,425,719 A 6/1995 Lessing
5,452,476 A 9/1995 Jenks
5,460,188 A 10/1995 Barrett
5,544,366 A 8/1996 Kato
5,561,865 A 10/1996 Fjelstul
5,671,481 A 9/1997 Giard
5,792,714 A 8/1998 Schindler et al.
5,802,619 A * 9/1998 Ralston ..... A41D 1/14 2/220
5,836,019 A 11/1998 Mccafferty
5,870,777 A 2/1999 Hans
5,878,441 A 3/1999 Busker et al.
5,956,765 A 9/1999 Chin
6,012,167 A 1/2000 Rosa et al.
6,018,823 A 2/2000 Ortmeier
6,041,441 A 3/2000 Counts et al.
6,076,195 A 6/2000 Klein
6,134,713 A 10/2000 Rosa et al.
6,138,282 A 10/2000 Follese
6,148,443 A 11/2000 Maastricht
6,308,340 B1 10/2001 Cook
6,336,226 B1 1/2002 Garcia
D463,652 S 10/2002 Lyden
6,526,597 B1 * 3/2003 Shepard ..... A41F 9/00 2/236
6,698,029 B2 3/2004 Tadros
6,772,446 B1 8/2004 Black
D561,978 S 2/2008 Soulides
7,424,962 B2 9/2008 Mooney
D615,279 S 5/2010 Savage
7,735,155 B2 6/2010 Kerkhoff
7,814,575 B2 10/2010 Hendrickson et al.
7,900,276 B2 3/2011 Hendrickson et al.
D638,609 S 5/2011 Gosse
8,024,819 B2 9/2011 Gearhart
8,028,345 B2 10/2011 Waite et al.
D654,661 S 2/2012 Savage
D659,951 S 5/2012 Leeper et al.
D660,553 S 5/2012 Farina et al.
D661,871 S 6/2012 Savage
8,272,073 B2 9/2012 Arensdorf et al.
8,321,964 B2 12/2012 Gernes
D686,799 S 7/2013 Farina et al.
D686,801 S 7/2013 Farina
D687,214 S 8/2013 Farina et al.
D701,676 S * 4/2014 Savage ..... D2/738
D711,626 S 8/2014 Savage
9,021,615 B2 5/2015 Cockram
9,254,010 B2 2/2016 Hedrick
D754,948 S 5/2016 Cockram
D769,614 S * 10/2016 Nejjar ..... D3/226
2004/0031830 A1 2/2004 Davis
2004/0210987 A1 10/2004 Carney
2004/0237173 A1 * 12/2004 Villalobos ..... A41D 1/06 2/236
2005/0066424 A1 3/2005 Salazar
2006/0218690 A1 10/2006 James
2007/0157367 A1 7/2007 Kerkhoff
2008/0115252 A1 5/2008 Dahan
2008/0189832 A1 8/2008 Oscher
2008/0301997 A1 12/2008 Tempini
2009/0049584 A1 * 2/2009 Stones ..... A41D 1/20 2/221

(56) References Cited

U.S. PATENT DOCUMENTS

| | | | | |
|---|---|---|---|---|
| 2009/0293167 | A1 | 12/2009 | Kottler | |
| 2009/0300818 | A1 | 12/2009 | Waite et al. | |
| 2010/0275344 | A1 | 11/2010 | Demarest et al. | |
| 2010/0281595 | A1 | 11/2010 | Gernes | |
| 2013/0048687 | A1 | 2/2013 | Do | |
| 2013/0276210 | A1 | 10/2013 | Clarke et al. | |
| 2013/0305433 | A1 | 11/2013 | Hedrick | |
| 2014/0182044 | A1* | 7/2014 | Cole | A41D 27/20 2/69 |
| 2014/0196194 | A1* | 7/2014 | Clarke | A41D 1/14 2/237 |
| 2015/0007379 | A1 | 1/2015 | Cockram | |
| 2015/0196071 | A1 | 7/2015 | Cockram | |
| 2016/0051035 | A1 | 2/2016 | Do | |
| 2016/0088887 | A1 | 3/2016 | Cockram | |
| 2016/0106161 | A1 | 4/2016 | Hedrick | |
| 2016/0143424 | A1* | 5/2016 | Stephens | A45F 3/005 224/222 |
| 2016/0331053 | A1 | 11/2016 | Gordon | |

OTHER PUBLICATIONS

Co-Pending U.S. Appl. No. 14/667,843, filed Mar. 25, 2015 and Published as US 2015/0196071 on Jul. 16, 2015.

Co-Pending Design U.S. Appl. No. 29/509,555, filed Nov. 19, 2014.

https://www.kickstarter.com/projects/1127833141/first-womens-fitness-pants-with-a-waistband-phone?ref=nav_search, "First Women's Fitness Pants with a Waistband Phone Pocket," Kickstarter Campaign for Phenomz Brand by Christian Phyfier, Funding Period Jun. 15-Jul. 28, 2013, including "No More Skepticism! Watch this video & tell your friends!" Jul. 1, 2013, and including "Be Phenomenal" video, undated, 16 pages.

Co-Pending U.S. Appl. No. 14/963,337, filed Dec. 9, 2015.

Co-Pending U.S. Appl. No. 29/509,555, filed Nov. 19, 2014.

Co-Pending U.S. Appl. No. 29/509,555, Notice of Allowance dated Jan. 21, 2016, 6 pages.

Gosportit, Yoga Pants and Capris, http://www.gosportit.com/collections/frontpage/products/capris, Available at least as early as Feb. 3, 2016, 7 pages.

Yana Athletics, Premium Yoga Pants for Women, http://www.yanaathletics.com, Available at least as early as Feb. 3, 2016, 7 pages.

* cited by examiner

ACTIVEWEAR WITH WAISTBAND POCKET

CROSS-REFERENCE TO RELATED APPLICATIONS

The present application claims priority to and is a Continuation-in-Part (CIP) application of U.S. patent application Ser. No. 14/667,843 filed on Mar. 25, 2015, which CIP application is a Continuation application of U.S. patent application Ser. No. 13/933,817 filed on Jul. 2, 2013, which Continuation application published as U.S. Patent Application Publication No. 2015/0007379. The present application also claims priority to Design patent application Ser. No. 29/509,555 filed on Nov. 19, 2014. The disclosures of these applications are hereby incorporated by reference herein in their entireties.

BACKGROUND OF THE INVENTION

Field of the Invention

The present invention relates generally to athletic outerwear or apparel, including in particular garments such as pants, shorts, skirts, skorts, shirts, and generally any garment with a waistband. More particularly, in embodiments the present invention relates to activewear garments with an interior concealed storage pocket disposed in the waistband of the garment. The purpose of the concealment extends beyond minimizing attention to the items stored within the pocket by allowing the wearer to participate in a variety of athletic activities or events while carrying personal items in a safe and concealed manner.

Description of Related Art

Men, women, and children participate more and more in recreational sporting activities and events such as running, tennis, golf, or biking, and in fitness activities and classes such as aerobics or yoga. When participating in these sporting activities there is often the dilemma of where to keep personal items, such as car keys, house keys, hotel keys, coins, cash, credit or debit cards, identification cards such as a driver's license, electronic devices, such as a phone, MP3 player, or tablet etc. Many times these items are placed in a pocket either in the legwear or in another item of clothing or a pack that is attached to the body at the arm, leg, wrist, or waist, such as a fanny pack. The items, as well as their conventional carrying means, typically create bulk, which is not desirable for freedom of movement during exercise. Because such packs can be cumbersome to the wearer and garments on the market typically do not have the capability to accommodate a wide range of items, oftentimes people who exercise will choose instead to leave doors unlocked instead of carrying their keys with them, or will leave their phones at home, which is not the best choice for personal safety.

Existing methods for securing these items include an additional pocket in the garment or in another item of clothing, or an expandable pouch or pocket that is somehow attached to the body such as the arm, leg, wrist, or waist. Several patents have attempted to address such methods for securing items. For example, U.S. Pat. No. 7,424,962 to Mooney, which is incorporated by reference herein in its entirety, describes a pocket strapped to the waist of one playing either golf or tennis. The pocket has a backing and front made of a fabric that is flexible and stretchable to hold golf or tennis balls and may be attached to a belt or may be worn in place of a belt. Similar devices exist for joggers, such as that disclosed in U.S. Pat. No. 4,601,418 to Gruzensky, which is incorporated by reference herein in its entirety, which describes a zippered pocket for money, keys, identification cards, and other personal items and which is constructed to be worn on the wrist or ankle.

There are items on the market for joggers that employ what is sometimes referred to as a pocket band. The band can go around the arm, the leg, the thigh, the waist, or the wrist of the wearer, such as that disclosed in U.S. Published Application No. 2004/0031830, which is incorporated by reference herein in its entirety. A zipper or Velcro (i.e., hook and loop type closure) closes the opening of the pocket band protecting the items inside from loss or theft. The adjustable pocket makes a portable compartment that eliminates the need to carry bulky purses, wallets, etc., and does not interfere with the freedom of movement of a jogger, however, the pocket band can interfere with the freedom of movement of the wearer while doing yoga or other activities that involve bending and other movements and can be cumbersome as it is an additional layer to wear.

Similarly, a concealed pocket incorporated into the apparel is sometimes used for securing personal items while exercising. For example, U.S. Pat. No. 5,836,019 to McCafferty describes a sock with a hidden pocket, while U.S. Pat. No. 4,852,188 to Marsh describes a panty-type garment with a security pocket, which patents are both incorporated by reference herein in their entireties. There are also hidden pockets added to jackets, shirts, hosiery, and hoodies. Additionally, activewear for joggers often have pockets in the front or back that are closed with zippers. Such pockets are incorporated into the garments using additional material to form the pocket. It would be much more cost effective and comfortable, however, to provide a pocket using the material of the garment itself without adding material for a pocket.

A "hipband pouch" is disclosed in U.S. Published Application No. 2013/0048687, which is hereby incorporated by reference herein in its entirety. The pouch is intended for use as an accessory and is worn in addition to a person's other exercise garments. The pouch comprises a tubular pocket with openings disposed laterally along a single circumferential seam such that the pocket openings are where the seam of the pouch is purposefully left open. Laterally spaced openings along the seam itself are prone to failure after repeated use in that the seam will tend to come apart at the point where the opening ends and the seam begins due to the opening being stretched to accommodate items. Much worse, the fabric may instead rip at this juncture requiring undesired repair of the garment. Additionally, such a pouch adds bulk to a user since it is worn in addition to the user's regular clothing and is not part of the activewear itself. Other disadvantages of such a pouch are that they tend to ride up on the user's torso and will typically not stay put where the user initially places the pouch, making its use uncomfortable or unaesthetic to the user or others.

US2013/0276210 discloses "lower torso athletic apparel with built in mobile device carrying panel" with a rectangular shaped panel of shear elastically deformed material overlaying the waistband of the athletic pants/shorts/skirts attached horizontally by stitching lines at the top and bottom of the panel to form a space between the attached panel and original waistband of the athletic pants/shorts/skirt for carrying and snugly retaining a mobile device. According to the disclosure, the panel enables greater than 50% visibility to the screen and use of the touch screen functions of the device through the fabric without removing the device from the panel. The panel extends around the entire waistband or part thereof and has one or more apertures for the insertion/removal of a mobile device. Australian Patent Publication No. AU2012254915 to the same inventor is similar. As mentioned previously, disadvantages of such a construction include additional manufacturing cost due to the additional material needed to create such a pocket, as well as the sheerness of the material which is expected to wear over time because it is not as durable as the material of the body.

From the above discussion it is apparent that what is desired is a pocket within the activewear that can hold personal items safely and securely, while not compromising the aesthetics and comfort in the design of the garment. A pocket such as this should provide convenient ergonomic access so the items may be retrieved during or after the sporting event with convenience. What is needed is activewear that fits, functions, and performs for the sport chosen, and yet looks and feels great while allowing for a place to safely keep personal items during participation in the sporting event. In other words, the activewear should be comfortable, and flattering, yet practical. It should also allow for the range of motion necessary for the sporting event. The activewear should function for the desired activity as well as have a pleasing appearance. The activewear should be durable and easy to wash while being constructed out of a minimal number of parts. The activewear should be cost effective, light weight, with a bulk-free waistband that allows a full range of movement of the wearer.

According to embodiments of the invention, a pocket within the waistband of the actual garment is capable of accomplishing one or more of these criteria and can be incorporated for example into shirts, skirts, shorts, skorts, and pants. In embodiments, the waistband goes all the way around the waist, and provides for comfort and flexibility in range of motion, while also providing a pocket space within the waistband. Access to the pocket within the actual waistband itself can be provided by slits or cuts in the fabric that are finished around the opening to provide for a strong and wear-resistant opening.

SUMMARY OF THE INVENTION

The numerous limitations inherent in conventional activewear with hidden pockets or pouches described above provide great incentive for a new and better form of activewear with a concealed pocket and which is capable of accounting for one or more of these issues. The present invention relates generally to athletic outerwear/apparel and particularly to athletic wear for the lower body, such as pants, shorts, capris, skirts, and skorts. More particularly, the present invention relates to athletic garments with a concealed storage pocket incorporated into the waistband of the garment.

In embodiments of the invention, the pocket can be formed by a first layer of material that provides for an exterior facing surface of the waistband and a second layer of material that provides for an interior facing surface of the waistband. Additional pieces and/or layers of material can also be included. The layers of material can be two pieces of material sewn together at the top, or provided as a single sheet of material folded over, and sewn together with the lower portion of the garment. This provides for an annular pocket that traverses the entire waist when worn.

In embodiments, the pocket can be configured as a single pocket encircling the waist, or can be portioned into two or more smaller regions covering from 0-360° around the waistband by incorporating one or more horizontal seams into the waistband. One or more openings to the pocket are provided by cuts or slits in the fabric. The slits can be disposed in the outwardly facing layer of material or in the layer of material intended to face or contact the user's body. In embodiments, the pocket does not have a closure, but could be closed, such as by a zipper, or Velcro or snaps or buttons, etc. Although not necessary, and in preferred embodiments, the openings to the pocket can be finished by a hem line, and/or by surging, and/or by ribbon sewn over the unfinished edge, and/or by using bias tape. Such a finished opening provides for a stronger pocket opening and leads to longevity of the garment. The items in the pocket, in embodiments, are held in place by the elasticity of the material the activewear is made from, and/or by the vertical or horizontal slit, which is smaller than the items placed within the pocket, but which expands to allow for the items to be placed within the pocket.

Specific embodiments of the invention can include activewear, such as pants, comprising: (i) a body portion, optionally with two pant legs, and a top edge defining a waistline; (ii) a waistband comprising a single sheet of material in a folded configuration or constructed from multiple pieces of material; (iii) wherein the body portion and the waistband are in direct communication with one another by a seam along the waistline, and optionally along 360 degrees of the waistline of the body portion; (iv) wherein the waistband, when joined with the waistline of the body portion, provides a pocket capable of holding items; and (v) wherein the waistband is configured to provide access to the pocket as one or more pocket openings, such as by introducing one or more cuts in the material to provide multiple pieces of material capable of being layered to form a pocket.

Embodiments of the invention include a garment comprising a body portion comprising fabric with an upper edge terminating as a 360° waistline and a 360° waistband comprising multiple pieces of fabric, such as four or six pieces of fabric. In such embodiments, a first and second piece of fabric define a first pocket on the waistband and a third and fourth piece of fabric define a second pocket on the waistband, and 360° of the waistline of the body portion is attached to a bottom edge of the waistband. The first pocket and second pocket each comprise at least one opening to provide pocket access. In a six-piece waistband construction, fifth and sixth pieces of fabric are added to cover a portion of the second and fourth pieces of fabric, respectively, and are disposed under the first and third pieces of material, respectively, to provide a more streamlined pocket opening.

Alternatively or in addition, the activewear can be configured such that the pocket is annular and extends 360° around the waistband.

In embodiments, alternatively or in addition, the activewear can be configured such that the waistband has a width of between approximately 1 and 8 inches wide.

The activewear can be alternatively or in addition configured such that the one or more pocket openings have a dimension of about 10-100% of the width of the waistband. For example, the activewear can be configured such that the one or more pocket openings have a dimension of about 25-50% of the width of the waistband. In preferred embodiments, the opening has a width that is 97%, 98%, 99%, or 100% of the width of the waistband.

Alternatively or in addition, the activewear can be configured such that the waistband comprises a horizontal seam encircling the waistband 360° and dividing the waistband in half into two annular regions, wherein an upper annular region is capable of being folded over a lower annular region comprising the pocket and the pocket openings.

In yet further embodiments, alternatively or in addition, the activewear can be configured such that the waistband comprises two or more vertical seams for dividing the lower annular region into smaller segments.

Further for example, activewear embodiments can alternatively or in addition comprise two vertical seams to divide the lower annular region into a front pocket and a back pocket, wherein each of the front and the back pocket extend 180° degrees around the waistband. Even further, for example, such activewear can be configured such that multiple vertical seams provide pockets at one or more various locations around the waistband.

The activewear can be configured such that one or more of the pocket openings are disposed on a side of the waistband contacting the wearer. Alternatively or in addition, the activewear can be configured such that one or more pocket openings have no closure and are finished around a pocket opening edges by one or more of a hem line, surging, ribbon sewn over the edge, or bias tape sewn over the edge. Alternatively or in addition the activewear can be configured such that one or more pocket openings have a closure chosen from a zipper, hook and loop type closure, hooks, buttons, or snaps.

In embodiments, the activewear can be configured such that items disposed in the pocket are held in place by one or more of fabric elasticity or pocket opening size.

The body portion of the activewear according to any embodiment herein can be an athletic pant style chosen from running pants, capri pants, tight shorts, or loose shorts.

Preferably, such activewear pants comprise a body portion comprising a leg portion configured as straight, boot cut, loose, or form fitting.

The activewear according to embodiments of the invention can comprise a waistband made from one or more of jersey, knit, cotton, nylon, spandex, rayon, polyester, or combinations thereof. Preferably, the activewear pants comprise a waistband made from about 80-90% nylon and from about 10-20% spandex.

Methods of making activewear of the invention are also included. Any method for making any of the embodiments described in this specification can be used. Preferred is a method of forming activewear pants said method comprising: (i) forming a waistband from an elongated sheet of material by: (a) joining opposing ends of the material to form a ring-like structure; and (b) folding the ring-like structure to align opposing edges of the material; (ii) providing a body portion comprising two apertures for legs of a user and having a top edge that defines a waistline; and (iii) joining the waistband to the body portion along the waistline to provide for an annular pocket in the waistband.

A waistband for any garment wherein the waistband comprises a concealed pocket is also included within the scope of the invention. In particular, a waistband comprising: (i) an annular pocket defined by a front and back layer of material forming a waistband; (ii) one or more cuts in the front or back layer of material to provide pocket openings; and (iii) a portion of the waistband capable of being folded to conceal the pocket openings is included.

Additional embodiments of the invention comprise a garment comprising a body portion comprising fabric with an upper edge terminating as a 360° waistline, and a waistband comprising fabric with two edges attached together. In this embodiment, 360° of the waistline is attached to the two edges of the waistband. The waistband may define one or more pockets capable of holding items, and the pockets may comprise one or more openings to provide access to the pockets.

Further embodiments of the invention comprise a garment comprising a body portion made of fabric having a top edge defining a 360° waistline and a waistband comprising a tube of fabric having two edges attached together. In this embodiment, the waistband is attached to the body portion along 360° of the waistline, and the waistband and the body portion are each disposed on opposing sides of the waistline. The waistband may provide one or more pockets capable of holding items and the pockets may comprise one or more pocket openings to provide access to the pockets.

Further embodiments of the invention comprise a garment comprising a fabric body portion comprising a top edge defining a torso aperture and a fabric waistband joined along 360° of the torso aperture at a circumferential seam, which waistband is a tube of material capable of providing a pocket for storing items in an interior of the tube. In this embodiment, the waistband and body are disposed on opposing sides of the torso aperture. The tube may have one or more openings to provide access to the pocket.

In embodiments, the pocket extends 360° around the waistband. Further, the waistband may comprise two or more seams to provide for multiple pockets. In embodiments, the one or more pocket openings may have a closure or no closure. During use items disposed in the one or more pockets may be held in place by fabric elasticity.

In embodiments, the body portion may be chosen from leggings, a yoga pant, a running pant, a capri pant, shorts, a skort, or a skirt. In embodiments, the waistband comprises material of one or more of jersey, knit, cotton, nylon, spandex, rayon, polyester, or combinations thereof. The waistband may comprise elastic or may have elasticity, such as a fabric with elasticity or an elastic fabric. A strip of elastic ribbon may be sewn into the top of the interior of the waistband for added security. Additionally, the waistband may comprise two or more seams to provide for a plurality of pockets.

The fabric of the body portion and/or of the waistband may comprise polyester.

In embodiments, the one or more pocket openings may be disposed from 5 to 90 degrees relative to one or more of the edges of the waistband. Further, the one or more pockets may be shaped and sized to accommodate a mobile phone.

In embodiments, the waistband may comprise a front pocket and a back pocket each with their own pocket opening.

Embodiments of the invention include a garment comprising a body portion comprising fabric with an upper edge terminating as a 360° waistline and a 360° waistband comprising four pieces of fabric. In this embodiment, a first and second piece of fabric define a first pocket on the waistband and a third and fourth piece of fabric define a second pocket on the waistband, and 360° of the waistline is attached to a bottom edge of the waistband. The first pocket and second pocket each comprise at least one opening to provide pocket access.

In embodiments, the first pocket and/or the first pocket opening is disposed at a first half of the waistband and the second pocket and/or second pocket opening is disposed at a second half of the waistband.

In embodiments, the first half of the waistband is disposed at the front of the garment and the second half of the waistband is disposed at the back of the garment.

In embodiments, the first half of the waistband and second half of the waistband are separated by two side seams laterally disposed on the waistband.

In embodiments, the first and second piece of fabric defining the first pocket are of unequal lengths such that the second piece is longer than the first piece, and the third and fourth piece of fabric defining the second pocket are of unequal lengths such that the fourth piece is longer than the third piece. In embodiments, the second piece of fabric is the same length as the fourth piece of fabric and/or the first piece of fabric is the same length as the third piece of fabric.

In embodiments, the second piece of fabric defines an inner layer of the first pocket and the first piece of fabric defines an outer layer of the first pocket, and the fourth piece of fabric defines an inner layer of the second pocket and the third piece defines and outer layer of the second pocket.

In embodiments, within the waistband the first pocket and second pocket are each further defined by a top seam, bottom seam, and side seam, whereby the first and second pieces of fabric are joined at their respective top, bottom, and side edges, and wherein the second pocket is further defined by a top seam, bottom seam, and side seam, whereby the third and fourth pieces of fabric are joined at their respective top, bottom, and side edges. The pieces of fabric can be sewn together in any order and/or one or more of the seams can be sewn at any point during the waistband construction.

In embodiments, the waistband comprises a first seam along top of the waistband, a second seam along the bottom of the waistband, and third and fourth seam as side seams extending from the bottom seam to the top seam.

In embodiments, the second piece of fabric is made of a different material than the first piece of fabric and the fourth piece of fabric is made of a different material than the third piece of fabric, and/or the second piece of fabric is made of the same material as the fourth piece of fabric. In the context of this specification, a different material can refer to any difference in the material, such as a different type of material, a different style of material, a different finish of the material, a different color material, a different design printed on the material, a different side or surface of the material, and so on. In embodiments, the pieces of material on the outside of the waistband (e.g., portion of the waistband facing publicly), such as the first, fifth, third, and sixth pieces of material can all be the same and can all be the same or different than the second and fourth pieces of material that form the inside of the waistband (e.g., portion of waistband against skin).

In embodiments, the second piece of fabric comprises a portion that extends beyond the first piece of fabric and the fourth piece of fabric comprises a portion that extends beyond the third piece of fabric.

In embodiments, the waistband comprises six pieces of fabric. The waistband can comprise the first, second, third, and fourth pieces of fabric as described above and additionally a fifth and sixth piece of fabric. In embodiments, a fifth piece of fabric is the same or different material as the first piece of fabric and is disposed over the portion of the second piece of fabric that extends beyond the first piece of fabric, and a sixth piece of fabric is the same or different material as the third piece of fabric and is disposed over the portion of the fourth piece of fabric that extends beyond the third piece of fabric. In some embodiments, the fifth and sixth pieces of material can be different from the first, second, third, and fourth pieces of material, which are the same.

For example, in a waistband with a six-piece or more construction, the waistband can comprise a first piece of fabric that constitutes a front exterior facing panel of the waistband and which is sewn over a second longer piece of fabric. The second longer piece of fabric constitutes an interior facing panel of the waistband and contacts the user's body during use. The first piece of fabric and the second piece of fabric together form a front pocket of the waistband. The material is cut to different lengths such that the difference in length between the first piece of fabric and the second piece of fabric provides for an opening into the front pocket. The same configuration is provided on the back side of the waistband with a third and fourth piece of fabric to form a back pocket on the back side of the waistband. A fifth piece of fabric is sewn over the second piece of fabric and under or over the first piece of fabric in a manner such that the fifth piece of fabric covers at least a portion of the second piece of fabric, provides access to the front pocket opening, and forms part of the exterior facing portion of the front panel of the waistband. Similarly, a sixth piece of fabric is sewn over the fourth piece of fabric and under or over the third piece of fabric in a manner such that the sixth piece of fabric covers at least a portion of the fourth piece of fabric, provides access to the back pocket opening, and forms part of the exterior facing portion of the back panel of the waistband.

In embodiments, the waistband comprises a top seam and bottom seam, and the 360° waistline is attached at the bottom seam of the waistband.

Embodiments of the invention comprise a garment comprising a body portion made of fabric having a top edge defining a 360° waistline, a waistband comprising four pieces of material comprising a first and second piece and a third and fourth piece. The first and second pieces of fabric are attached along three edges forming a first pocket and the third and fourth pieces are attached along three edges forming a second pocket. The bottom of the waistband is attached to the top of the body portion along 360° of the waistline, and the waistband and the body portion are each disposed on opposing sides of the waistline. The waistband provides one or more pockets capable of holding items and the pockets comprise one or more pocket openings to provide access to the pockets.

In embodiments, the second piece of fabric is longer than the first piece of fabric and the fourth piece of fabric is longer than the third piece of fabric. The second piece of fabric defines an inner layer of the first pocket (e.g., an interior facing panel of the waistband) and the first piece of fabric defines an outer layer of the first pocket (e.g., an exterior facing panel of the waistband). The fourth piece of fabric defines an inner layer of the second pocket and the third piece of fabric defines an outer layer of the second pocket.

In embodiments, the second piece of fabric and the fourth piece of fabric are attached at two side seams forming a 360° inner layer of the waistband.

In embodiments, a portion of the second piece of fabric is not covered by the first piece of fabric and/or a portion of the fourth piece of fabric is not covered by the third piece of fabric.

In embodiments, a fifth piece of fabric covers the portion of the second piece of fabric that is not covered by the first piece of fabric and a sixth piece of fabric covers the portion of the fourth piece of fabric that is not covered by the third piece of fabric. In embodiments, the second, third, fourth, and fifth pieces of fabric are attached at a first side seam of the waistband and the first, second, fourth, and sixth pieces of fabric are attached at a second side seam of the waistband, where the second side seam is preferably disposed about 180 degrees around the waistband from the first side seam.

Embodiments of the invention include a 360° waistband comprising four pieces of fabric. A first and second piece of fabric define a first pocket on the waistband (preferably disposed on the front of the garment/waistband) and a third and fourth piece of fabric define a second pocket on the waistband (preferably disposed on the back of the garment/waistband). The second piece of fabric is longer than the first piece of fabric and has a portion that extends beyond the first piece of fabric, and the fourth piece is longer than the third piece of fabric and has a portion that extends beyond the third piece of fabric. The first pocket and second pocket each comprise at least one opening to provide access to each pocket.

In embodiments, the 360° waistband includes two additional pieces of fabric. A fifth piece of fabric is disposed over the portion of the second piece of fabric that extends beyond the first piece of fabric and is disposed under the first piece of fabric. A sixth piece of fabric is disposed over the portion of the fourth piece of fabric that extends beyond the third piece of fabric and is disposed under the third piece of fabric. In embodiments, the first piece of fabric is the same material as the fifth piece of fabric but different material than the second piece of fabric and the third piece of fabric is the same material as the sixth piece of fabric but different material than the fourth piece of fabric. In embodiments, the multiple pieces of fabric are the same material but each piece of fabric has a first and second surface with a different appearance (e.g., a surface that typically is intended to be hidden from view when worn as compared with a surface intended to be seen when worn). In embodiments, the surface of the material intended to be seen when worn, which typically has a more aesthetically pleasing appearance, will usually be disposed as an exterior facing surface of the overall garment and the surface intended to be hidden from view when worn will usually be disposed as an interior facing surface of the overall garment. Some materials may have both surfaces that are the same, but most materials will have an outside surface (e.g., the surface intended to be seen when worn) and an inside surface (e.g., the side facing the user). In a six-piece construction embodiment, the waistband for example can comprise six pieces of material that are made of the same material, but each piece of material having a first and second surface which have different surface texture characteristics or a different appearance. The first and fifth pieces of material can be attached to the second piece of material in such a manner that the same surfaces of the pieces of material face one another (e.g., the back or rough-finish or unfinished or underside surface of the first and fifth pieces of material face the back or rough-finish or unfinished or underside surface of the second piece of material while the surfaces intended to be exterior facing face away from one another). The third and sixth pieces of material can be attached to the fourth piece of material in a similar manner. Using such a construction, all exterior surfaces of the waistband of the garment are the same, including the outwardly facing surface of the waistband and the inwardly facing surface facing the wearer.

Embodiments of the invention include a method of manufacturing a waistband. Such methods can comprise (i) providing a first, second, third, fourth, fifth, and sixth piece of fabric; (ii) attaching the second and fourth pieces of fabric together to form an inner waistband loop with a first side seam and a second side seam; (iii) attaching the first and sixth pieces of fabric together to form a first outer waistband portion with a first outer waistband seam, overlaying the first outer waistband seam with the first side seam of the inner waistband loop, and attaching the first outer waistband portion to the inner waistband loop; and (iv) attaching the third and fifth pieces of fabric together to form a second outer waistband portion with a second outer waistband seam, overlaying the second outer waistband seam with the second side seam of the inner waistband loop, and attaching the second outer waistband portion to the inner waistband loop.

Such methods can include providing from four to six pieces of fabric comprising an outside front band (first piece), inside front band (second piece), outside back band (third piece), inside back band (fourth piece), optionally a front covering segment (fifth piece), and optionally a back covering segment (sixth piece). The pieces of fabric can be attached by:

(i) connecting the inside front band and inside back band to form a loop with two side seams, which loop comprises the inner waistband, (ii) attaching the back covering segment to the front outside band to form a joined back covering segment/front outside band piece, (iii) attaching the front covering segment to the back outside band to form a joined front covering segment/back outside band piece, (iv) matching the seam of the joined front covering segment/back outside band piece to one side seam of the inner waistband and sewing the joined front covering segment/back outside band piece to the inner waistband except for a portion of the back outside band that is about 5 inches from the second side seam, (v) matching the seam of the joined back covering segment/front outside band piece to the second side seam of the inner waistband, overlapping the back outside band over the back covering segment, or vice versa, and sewing around the waistband, and (vi) overlapping the front outside band piece over the front covering segment, or vice versa, and sewing to overlap stitches at the side-seam of the waistband.

DETAILED DESCRIPTION OF PREFERRED EMBODIMENTS

Figure 1A:
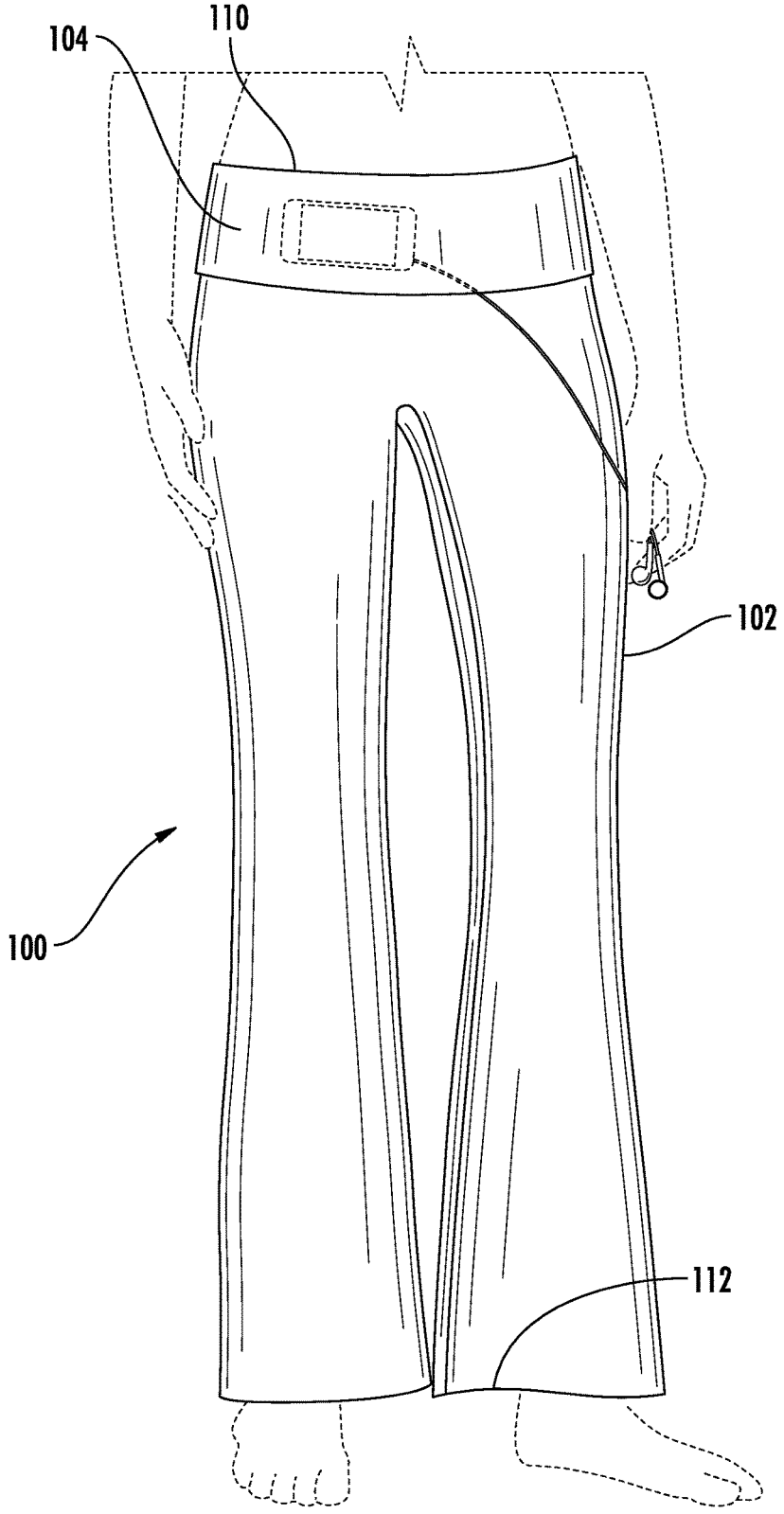
FIGS. 1A-D are schematic drawings showing various BOOT CUT type activewear embodiments according to the invention with a fold-over, annular waistband pocket, where the waistband is folded down to conceal pocket opening(s) (FIG. 1A); the waistband is unfolded to reveal a right-side vertical pocket opening (FIG. 1B); the waistband is folded up to reveal a left-side horizontal pocket opening (FIG. 1C); and the waistband is folded up to reveal vertical pocket openings on the left and right sides of the pant (FIG. 1D).

Reference will now be made in detail to various exemplary embodiments of the invention. Embodiments described in the description and shown in the figures are illustrative only and are not intended to limit the scope of the invention, and changes may be made in the specific embodiments described in this specification and accompanying drawings that a person of ordinary skill in the art will recognize are within the scope and spirit of the invention.

The present invention relates generally to athletic apparel and more particularly to activewear pants, shorts, skirts, skorts, shirts, and so on. Generally, any garment with a waistband can be adapted to incorporate one or more features of the waistband pocket of the present invention. More particularly, the present invention relates to activewear garments with a waistband pocket.

An object of the present invention is to provide activewear that is easy to manufacture, can be mass produced, and is less expensive to make due to constructing the apparel from a minimum number of parts and using less material than other garments may use to provide pockets. Another object of the present invention is to provide new and improved activewear that incorporates a concealed pocket of simple construction within the garment. Another object of the present invention is to provide new and improved activewear with a pocket for hands-free secure carrying of personal items while the wearer participates in athletic events or exercise activities. Another object of the present invention is to provide new and improved activewear with a concealed pocket that an individual can easily access while also providing securement of articles therein. Yet another object of the present invention is to provide a concealed pocket in activewear such that an item stored in the concealed pocket would be relatively undetectable. Embodiments of activewear according to the invention can comprise a wide variety of styles and lengths useful for different athletic activities.

Preferred embodiments of the invention include activewear comprising: (i) a waistband that functions as a pocket capable of retaining items, and (ii) one or more pocket opening. In especially preferred embodiments, the pocket is the waistband itself and no additional material is used to provide or create the pocket.

In various embodiments, the pocket opening is by a slit. The opening is preferably formed by cutting the fabric of the waistband. The slit or cut type opening can be punched, cut, torn, or by similar means, into the garment at any point during the manufacturing process, such as prior to, during, or after joining the waistband with the remainder of the garment. For example, the material for the waistband can be formed from a single piece of material or multiple pieces of material sewn together, with one or more pockets openings disposed at one or more desired locations on the waistband. One or more additional seams can be introduced to the waistband portion of the pant, for example, to divide the 360° annular pocket region into two or more smaller segments. In especially preferred embodiments, there are two perpendicular side seams to divide the annular region into a front pocket extending 180° around the waistband and a back pocket extending the remaining 180° around the waistband. Each of the front and back pockets can have their own pocket opening for access to the pocket.

In various embodiments, the one or more pocket slits and the one or more pockets can be any number, for example, ranging from 1-20, such as 1, 2, 3, 4, 5, 6, 7, 8, 9, 10, 11, 12, 13, 14, 15, 16, 17, 18, 19, or 20. The slits and pocket seams, if present, can be disposed at any desired angular location from 0-360° around the waistband. Likewise, the slit type openings can be disposed at any location along the width of the waistband. The slit(s) can be oriented in any direction from vertical to horizontal relative to an edge of the waistband and in between, such as horizontal (parallel with an edge of the waistband), or 5°, 10°, 15°, 20°, 25°, 30°, 35°, 40°, 45°, 50°, 55°, 60°, 65°, 70°, 75°, 80°, 85° above the horizontal, such as at about 90° (i.e., perpendicular to an edge of the waistband) above horizontal.

In other embodiments, the waistband is formed from four pieces of material, with a first and second piece of material forming a first pocket and a third and fourth piece of material forming a second pocket. The first and second piece of material may be of the same or of unequal lengths and the third and fourth piece of material may be of the same or of unequal lengths. The pockets may be formed by overlaying one piece of material over the other, such as the shorter piece of material over the longer piece of material and joining them together. As part of the waistband, the two pieces of material have seams on three sides of the shorter piece such that the fourth side of the shorter piece represents the pocket opening. Thus, in this embodiment, the longer pieces represent an inside band and define and inside layer of the pocket, and the shorter pieces form part of an outside band and define an outer layer of the pocket. Additionally, the waistband may be formed by joining the two longer pieces together to form a circle and sewing them together where their edges meet to form two side seams. The waistband may be attached to the remainder of the garment along the waistline. In embodiments, the waistband may additionally have a 360° top seam and a 360° bottom seam, and the waistband may be joined to the garment by the 360° bottom seam.

In embodiments, a portion of the two longer pieces extends beyond the shorter piece and is exposed, and in some embodiments, the shorter piece and longer piece are made of different material, or the fabric of the shorter piece is oriented in a different direction than the longer piece such that the outwardly facing surfaces of the material are different surfaces giving the appearance of different materials. In some embodiments, it may be desirable to present a uniform presentation to the waistband so that it appears to be made of the same piece or type of material. In these embodiments, the waistband may be additionally formed by a fifth and sixth piece of material that covers the portion of the two longer pieces that extend beyond the shorter piece. The fifth and sixth piece of material may be of the same material as the shorter pieces and placed over the longer piece near the pocket opening and extending slightly beyond so that it underlies a portion of the shorter piece. In other embodiments, the shorter piece and longer piece are the same material and are oriented in the same direction such that a fifth and sixth piece of material are not needed since the outwardly facing surfaces of the materials are the same.

In various embodiments, the height of the waistband may be any height and for example can vary from approximately 1 inch to 8 inches. The height/width of the waistband and the height/width of the pocket slit in various embodiments may be of any height and can for example vary from approximately 1 inch to 8 inches. Any height/width waistband and any height/width pocket slit can be used including for example, 0.5 inches, 1 inch, 2 inch, 3 inches, 4 inches, 5 inches, 6 inches, 7 inches, or 8 inches, or even ½ or ¼ inches between these numbers. The length of the pocket slit can be any length as well, such as from between 0% and 100% of the length of the waistband, including from 5%, 10%, 15%, 20%, 25%, 30%, 35%, 40%, 45%, 50%, 55%, 60%, 65%, 70%, 75%, 80%, 85%, 90%, or 95% of the length of the waistband. In embodiments, the pocket opening can be vertical, running half the height/width of the waistband, for instance a slit height of about 1 inch in a 2 inch high/wide waistband, or about 1.5 inches in a 3 inch high/wide waistband, or about 2 inches in a 4 inch high/wide waistband, or about 2.5 inches in a 5 inch high/wide waistband, or about 3 inches in a 6 inch high/wide waistband. The slit can be horizontal with the same length ratio scheme, or multiple slits can be used to access the pocket with a combination of vertical and horizontal slits.

In various embodiments, the waistband may fold-over and still be intended to fit on the wearer's waistline typically somewhere between the top of the person's hipbone and their navel. In other embodiments, the waistband is a non-fold-over waistband, meaning if it were folded over in its entirety it would fall outside this region. In various embodiments, the waistband has no seams segregating the waistband into smaller regions. The waistband, however, could have a seam that would create a smaller space for the pocket, such as a horizontal seam encircling the waistband and dividing the fold over waistband in half into two annular regions, an upper annular region that can be folded over the lower annular region; or such as one or more vertical side seam for dividing the annular region in half to provide one pocket in the front and one pocket in the back and where each pocket extends 180° around the waistband; or such as multiple vertical side seams to provide pockets at one or more various locations around the waistband extending from 0-180° around the waistband.

In various embodiments, the pocket slit does not include a closure. Optionally, the pocket slit can include any type of closure such as Velcro, a zipper, hooks, buttons, snaps, hook and loop, laces, or a similar mechanism.

In various embodiments, the items are held in place in the pocket by the elasticity of the material or may be held in place by the size of the slit, which is smaller than the item but which can be stretched to accommodate the item. The pocket slit can run in any suitable direction and distance, on either the front or back side of the activewear.

In various embodiments, the activewear can be athletic pants, running pants, capris pants, tight shorts, loose shorts, a skirt, a skort, or even a shirt. Indeed, any article of clothing that has a waistband can incorporate objects of the invention. In various embodiments the leg of the pant can be straight, boot cut, tight, or loose.

Activewear embodiments of the invention may be made of any desirable material and/or combination of materials. The waistband may be made from the same and/or different material as the remainder of the garment. In some embodiments the material may be breathable, sweat absorbing, water resistant, elastic, ultra comfortable, and/or performance-driven. An elastic type material may enhance the fit around the body of the wearer, thereby improving the comfort and/or enhancing the concealment of the items in the pocket. In some embodiments the material may be jersey, fleece, terry cloth, knit fabric, cotton, organic cotton, modal, viscose, PILAYO, heathered PILAYO, nylon, spandex, polyester, or rayon, or a blend of any of the materials. The knit fabric may be any knit fabric known in the art such as double knit, single knit, baby rib knit, interlock knit, or textured novelty knit.

Examples of blends that various embodiments may be made from include polyester/rayon/spandex blends, such as 47% polyester, 47% rayon, and 6% spandex; or from 30-60% polyester, 30-60% rayon, and 1-20% spandex; such as from 40-50% polyester, 40-50% rayon, and 2-18% spandex, such as from 43-49% polyester, 43-49% rayon, and 3-15% spandex; such as from 45-52% polyester, 45-52% rayon, and 4-10% spandex; including from 35-50% polyester, 40-50% rayon, and 5-8% spandex, and so on. Likewise, a blend of 88% nylon and 12% spandex is also preferred, or 90:10 nylon:spandex, or anywhere from 70-98% nylon and 2-30% spandex could be used.

In embodiments, the fabric blend can comprise from 1-6 types of materials, such as from 1, 2, 3, 4, 5, or 6 types of materials. These materials can be present in any amount, including for example where the blend is 50:50, or 45:55, or 40:60 or 35:65, or 30:70, or 25:75, or 20:80, or 15:85, or 10:90, or 5:95, or each component is present from about 1-99%, such as from 2-95%, or from about 3-98%, or from 4-97%, or 5-90%, or 6-92%, or 7-91%, or 8-96%, or 9-94%, or 10-93%, or 11-89%, or 12-88%, or 13-87%, or 14-86%, or 15-85%, or 16-84%, or 17-83%, or 18-82%, or 19-81%, or 20-80%, or 21-79%, or 22-78%, or 23-77%, or 24-76%, or 25-75%, or 26-74%, or 27-73%, or 28-72%, or 29-71%, or 30-70%, or 31-69%, or 32-68%, or 33-67%, or 34-66%, or 35-65%, or 36-64%, or 37-63%, or 38-62%, or 39-61%, or 40-60%, or 41-59%, or 42-58%, or 43-57%, or 44-56%, or 45-55%, or 46-54%, or 47-53%, or 48-52%, or 49-51%, or 50% each.

Particular examples of blends can include 97% cotton with 3% spandex, or from about 80-99% cotton with about 1-20% spandex, such as a 99:1, or 98:2, or 97:3, or 96:4, or 95:5, or 94:6, or 93:7, or 92:8, or 91:9, or 90:10, or 89:11, or 88:12, or 87:13, or 86:14, or 85:15, or 84:16, or 83:17, or 82:18, or 81:19, or 80:20, or 79:21, or 78:22, or 77:23, or 76:24, or 75:25, or 74:26, or 73:27, or 72:28, or 71:29, or 70:30 cotton:spandex blend, or cotton:polyester blend, or polyester/spandex blend. These materials can be used for one or more of the waistband, the legs of the garment, and/or the crotch or other parts of the garment, with any one or more of these parts of the garment being the same or different. Preferred materials and blends can include one or more of organic cotton/spandex, cotton/modal, viscose/spandex, PILAYO (SUPPLEX Nylon/LYCRA Spandex), Heathered PILAYO (SUPPLEX Nylon/Polyester/LYCRA Spandex), or COOLMAX (polyester). The lists of materials and compositions of the fabric provided in this specification are not meant to be exhaustive but only representative of the types of materials and amounts of material that could be used.

Figure 1B:
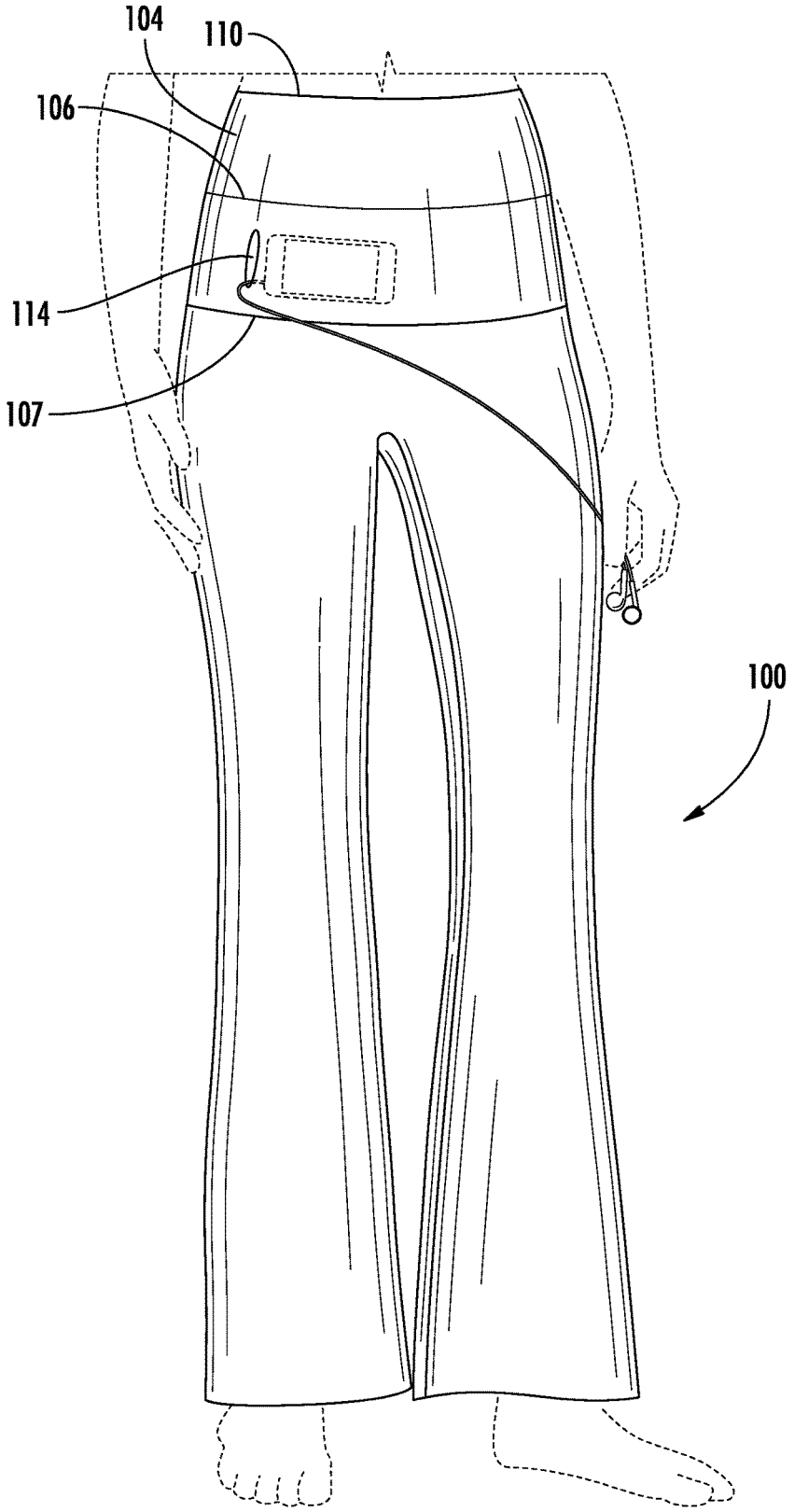
Figure 1C:
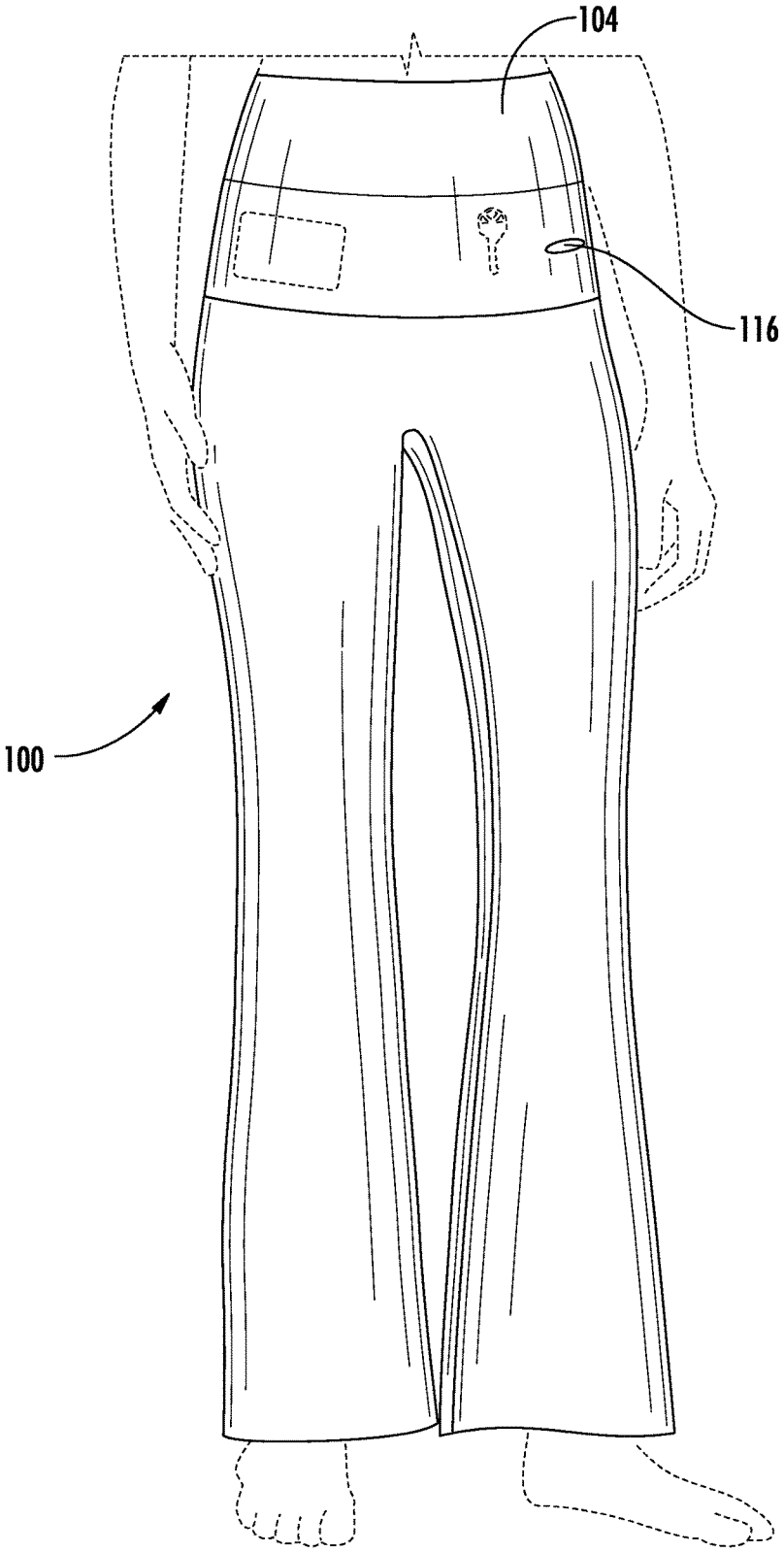
Figure 1D:
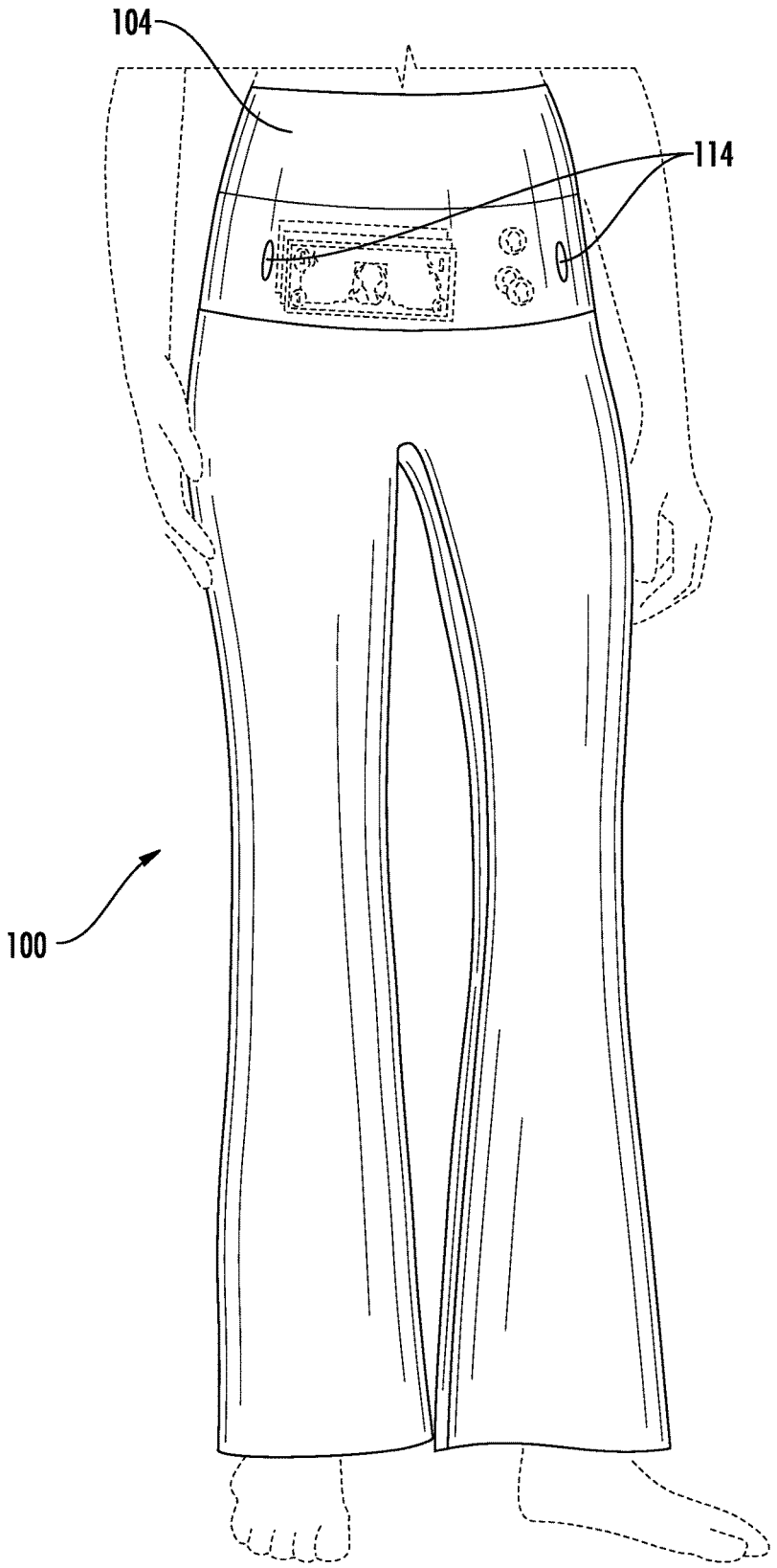
Figure 1E:
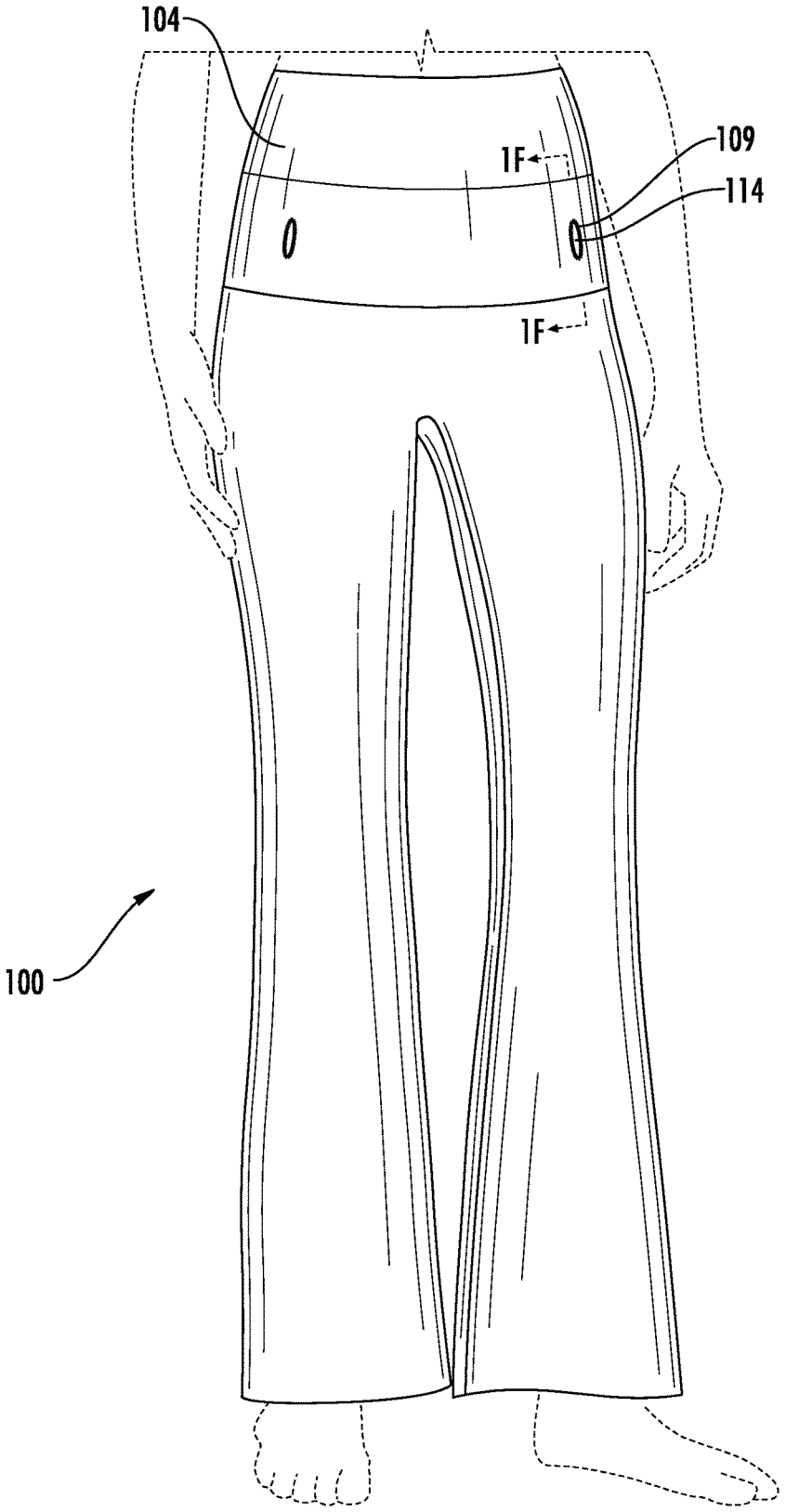
FIGS. 1E-F are schematic diagrams showing BOOT CUT type activewear of the invention with an unfolded, annular waistband pocket where the pocket is about half the width of the waistband and comprises left and right vertical pocket openings (FIG. 1E); and a cross-sectional view of the waistband pocket of FIG. 1E along the pocket opening (FIG. 1F).
Figure 1F:
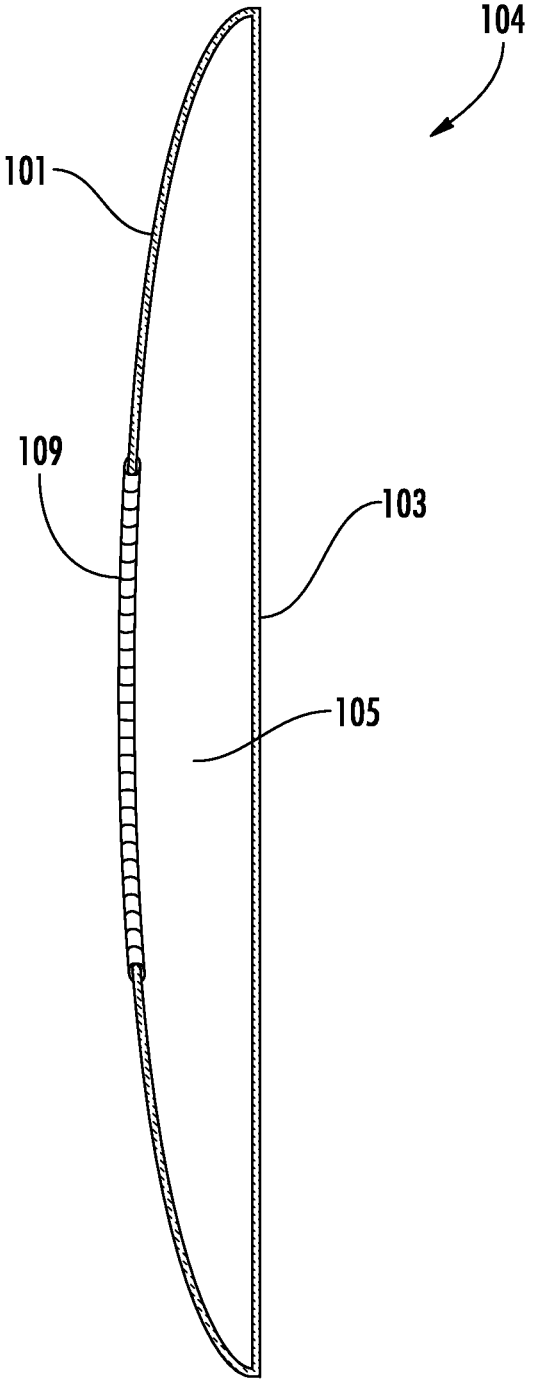

Referring now to the figures, more particular embodiments will be described as illustrated in FIGS. 1A-F, which are schematic drawings illustrating various waistband pocket embodiments with variations for example on configurations for the pocket slit. FIGS. 1A-D are schematic drawings showing various BOOT CUT type activewear embodiments according to the invention with a fold-over, annular waistband pocket, where the waistband is folded down to conceal pocket opening(s) (FIG. 1A); the waistband is unfolded (or folded up) to reveal a right-side vertical pocket opening (FIG. 1B); the waistband is folded up to reveal a left-side horizontal pocket opening (FIG. 1C); and the waistband is folded up to reveal vertical pocket openings on the left and right sides of the pant (FIG. 1D). FIGS. 1E-F are schematic diagrams showing BOOT CUT type activewear of the invention with an unfolded, annular waistband pocket where the pocket is about half the width of the waistband and comprises left and right vertical pocket openings (FIG. 1E); and a cross-sectional view of the waistband pocket of FIG. 1E along the pocket opening (FIG. 1F).

More particularly, FIG. 1A is a representative diagram of an embodiment of the activewear garment of the present invention shown in BOOT CUT style with a 6 inch waistband folded down to hide the pocket opening of the annular waistband pocket. The waistband pocket in this embodiment is 3 inches in height, which is half the height of the entire waistband. As illustrated, a portable media player, such as an IPOD, is concealed and secured within the annular waistband pocket by the 3 inch fold-over portion of the waistband.

As shown in FIG. 1A, there is provided an activewear garment 100 according to aspects described herein. The activewear garment 100 includes a body portion, shown generally as 102, and a waistband 104. Each portion of the activewear garment may be formed from a textile element as is discussed in greater detail at other portions of this specification. The body portion 102 and the waistband 104 may be joined by any known method of joining multiple textile elements, such as stitching, adhesives, and the like. The body portion 102 generally includes a main portion configured to fit around the midsection of the wearer, including the abdomen and the gluteal areas, and two leg portions that extend from the main portion through which a wearer's legs may extend. In alternate embodiments, the leg portions may be longer or shorter than the leg portions shown in FIG. 1A, or may be of a tighter or looser fit on the wearer. In embodiments, the textile element of the waistband 104, the main portion of the body 102, and the leg portions may comprise the same or different materials and/or the same or different compositions of materials. The body portion 102 may be formed of any suitable material to provide comfort to the wearer. In some embodiments the body portion 102 may be formed from jersey, knit fabric, cotton, nylon, spandex, polyester, organic cotton, viscose, or a blend of any of the materials, such as a polyester/rayon/spandex blend. Any of the types of materials and/or compositions of materials provided in this specification may be used for any embodiment of garment described herein.

The body portion 102 includes a plurality of apertures 110, 112. A first, torso aperture 110 is arranged at a top of the body portion 102 and is sized to accommodate the torso of the wearer. This torso aperture 110 may be sized to fit a variety of persons and is preferably shaped and sized to fit around the waistline of a wearer, such as between the top of the hipbone and the navel of the user or higher on the torso. In addition, the body portion 102 of the activewear garment 100 may include an elastic element such that the garment 100 may stretch to fit a variety of wearers. The waistband 104, and/or the body portion 102, may be formed of an elastic-type material, allowing the torso aperture 110, or the garment 100, to stretch, as needed to accommodate larger users or to provide for a more desired form fitting appearance when worn by the wearer. In some embodiments, two leg apertures 112 are included in body portion 102. The leg apertures 112 may vary from straight, boot cut, tight, or loose. However, in other embodiments such as a skirt, leg apertures are not included.

As shown in FIG. 1A, the waistband 104 comprises a hidden pocket that may contain items of the wearer for safe keeping. Access to the pocket is provided by an opening to the pocket that is hidden by an upper portion of waistband 104 when that portion of the waistband is folded down. Because of this novel construction the waistband 104 can be readily folded down over itself or the remainder of the body portion 102 of the activewear. As illustrated, the pocket opening can provide a way for wearers of the garment to enjoy music or other media by allowing for the wires of earbuds to protrude from the pocket while a portable media player, such as an IPOD, is retained safely and securely within the pocket. The fold-over portion of waistband 104 provides an additional level of security to retaining items and concealing the items within the hidden pocket.

FIG. 1B shows the same style pant as illustrated in FIG. 1A with the fold-over waistband 104 in an unfolded position (or folded up) to reveal a pocket opening 114 to the waistband pocket. The height of the pocket opening 114 (here, vertically disposed) or slit in this embodiment is about one-half to one-third the height of the pocket, or from about 1-1.5 inches in height. As shown, the fold-over waistband 104 can comprise multiple regions, such as two regions. In this embodiment, provided is an upper waistband portion terminating at an upper waistband edge along which is disposed the torso aperture 110 and a lower waistband portion terminating at a seam 107 between the waistband 104 and the body 102. These regions are divided by seam 106 that runs between and parallel with torso aperture 110 at the upper edge of the waistband and seam 107 at the lower edge of the waistband. The seam 106 is optional and additional seams can be included, whether parallel or perpendicular to seam 106, to further divide the waistband into several smaller regions and/or pockets. Here, the pocket region is in the lower portion of waistband 104 and extends 360° around the waistband of the garment and is about half the height of the waistband, or about 3 inches wide.

FIG. 1C shows the same style pant as illustrated in FIGS. 1A-B with a 1.5 inch horizontal pocket slit 116 on the left side of the waistband 104 of the pant rather than on the right side, as is shown in FIG. 1B. Although shown unfolded in this embodiment, waistband 104 may be in a folded down position so as to hide the horizontal pocket slit 116 or may be in an extended position to expose the pocket slit, as shown. The wearer of the garment 100 can use the pocket to stow away personal items, such as lipstick or other make up, house or car keys, hotel keys or credit cards, money, mobile phones, portable media players, radios, mace, and so on. As shown in FIG. 1C the waistband pocket is useful for securing keys and credit cards. A benefit of the waistband pocket of the invention is that the pocket is capable of accommodating multiple different items in a safe and secure manner. For example, existing garments have pockets configured for holding just a phone or just a key and are shaped and sized for retaining that item in particular. When the user puts a key in a pocket intended for a phone, the key can be dislodged and lost. Similarly, a user with a garment with a pocket for holding a key will not be able to stretch the pocket opening and/or the pocket itself enough to accommodate a phone. In contrast, the waistband pocket of the invention is configured to retain any number of different items. In this embodiment items such as keys and credit cards can be inserted into the opening 116 and positioned at any position around the waistband 104. Here, the credit card is positioned at the right front of the garment, while the key is positioned at the left front of the garment and closer to opening 116. Likewise, because the pocket in this configuration extends 360° around the waistband 104, the items can be pushed into the opening 116 and then maneuvered around to the back side of the garment to conceal the items along the backside of the wearer.

Alternatively, multiple pocket openings can be provided in the front and/or back of the waistband of the garment. As shown in FIG. 1D, which shows the same style pant as illustrated in FIGS. 1A-C, the garment 100 can comprise a plurality of pocket slits 114, 116 disposed at various positions along the waistband 104 of the garment 100. In this embodiment, two pocket openings, 1 inch vertical pocket slits 114, are disposed on the left and right sides of the waistband 104. Such a configuration may provide for easier insertion and retrieval of multiple items stored in the waistband 104. Similar to other embodiments, although shown unfolded in this embodiment, waistband 104 may be in a folded down position so as to hide the vertical pocket slits 114 or may be in an extended position to expose the pocket slit, as shown. As shown in FIG. 1D, the pocket of the waistband can be used to stow away paper money on one side of the waistband and coins on the opposing side.

FIG. 1E provides more detail about various configurations of the pocket and pocket opening for garment 100. Multiple pocket slits can be provided to access the pocket of the waistband. As shown in FIG. 1E, two vertical pocket openings 114 can be provided in the waistband 104, where one or more or all of pocket openings 114 have a finished edge 109. Depending on the type of fabric used, a finished edge may be desired to prevent fraying of the fabric after repeated use and/or washing. The openings 114 to the pocket can be finished by a hem line, and/or by surging, and/or by ribbon sewn over the unfinished edge, and/or by using bias tape. A finished opening provides for a stronger pocket opening and leads to longevity of the garment. In this embodiment, the finished edge 109 is provided by sewing around the edge to fortify the edge with additional thread or in a similar manner to providing for button holes. In preferred embodiments, the edge is finished in a manner that provides for the opening to be stretched to accommodate items larger than the opening. In this manner, such larger items can be inserted into the waistband pocket and retained there without falling back through the opening since the opening is smaller than the object. The items are alternatively or in addition retained in the waistband pocket due to the type of material used in waistband 104, such as a polyester/rayon/spandex blend or similar fabric supplying the desired amount of elasticity to constrict an item once placed in the pocket.

FIG. 1F provides additional detail about the pocket of waistband 104. More particularly, a cross-sectional view of the pocket is provided, which shows a cross section of the annular region defined by the pocket. As illustrated, pocket 105 can be formed from a single sheet of material folded over to provide for space between the folded sheet. The folded sheet comprises a front layer of material 101 and a back layer of material 103. When a garment containing the waistband pocket 105 is worn by a wearer in a typical manner, the back layer of material 103 is in contact with the waist of the wearer, while the front layer of material 101 will face outward and be seen by others. The finished opening 109 to the pocket 105 can be incorporated into the fabric at any point but is preferably introduced prior to partial formation of the waistband, or prior to complete formation of the waistband. For example, the finished openings 109 can be added to the sheet of fabric in a similar manner to button holes. Then the material can be joined at the elongated ends of the fabric to provide the sheet of fabric as a ring of material. The ring-like sheet of material can then be folded over on itself and sewn around the bottom elongated edges of the front 101 and back 103 layers to join the material and create an annular or tubular region between layers 101, 103. Alternatively or in addition, once the sheet of material is folded over, the sheet of material can be joined with the body portion of the garment along the elongated edge of the body portion as well. Sewing or joining these edges (the body portion edge, the front layer 101 edge, and the back layer 103 edge) together simultaneously may save on manufacturing steps and costs.

Figure 2A:
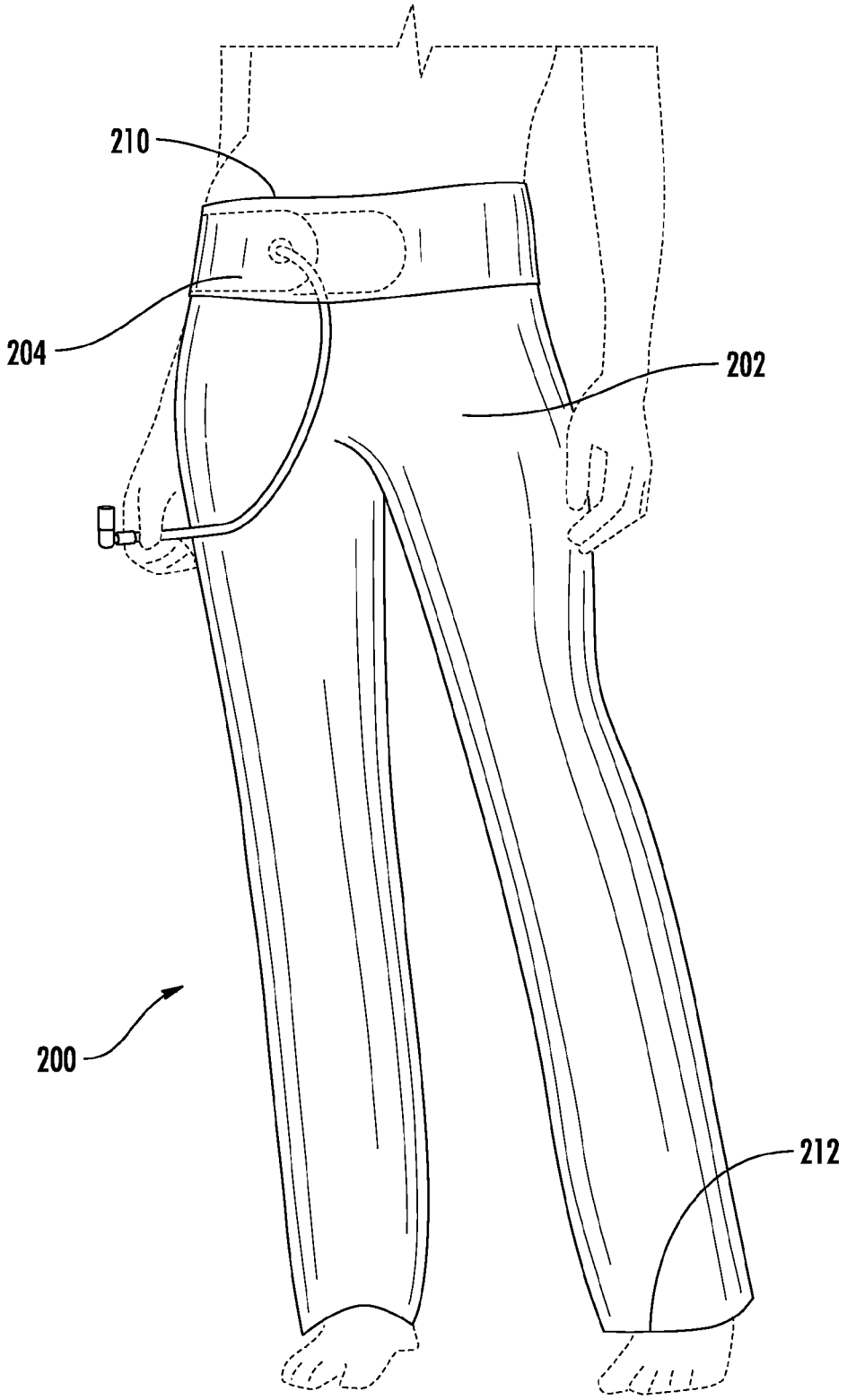
FIGS. 2A-B are schematic diagrams illustrating a STRAIGHT LEG type pant of the invention comprising a waistband with an annular pocket, where the waistband is folded over to conceal the pocket opening (FIG. 2A); and where the waistband is unfolded to reveal a right-side vertical slit pocket opening (FIG. 2B).
Figure 2B:
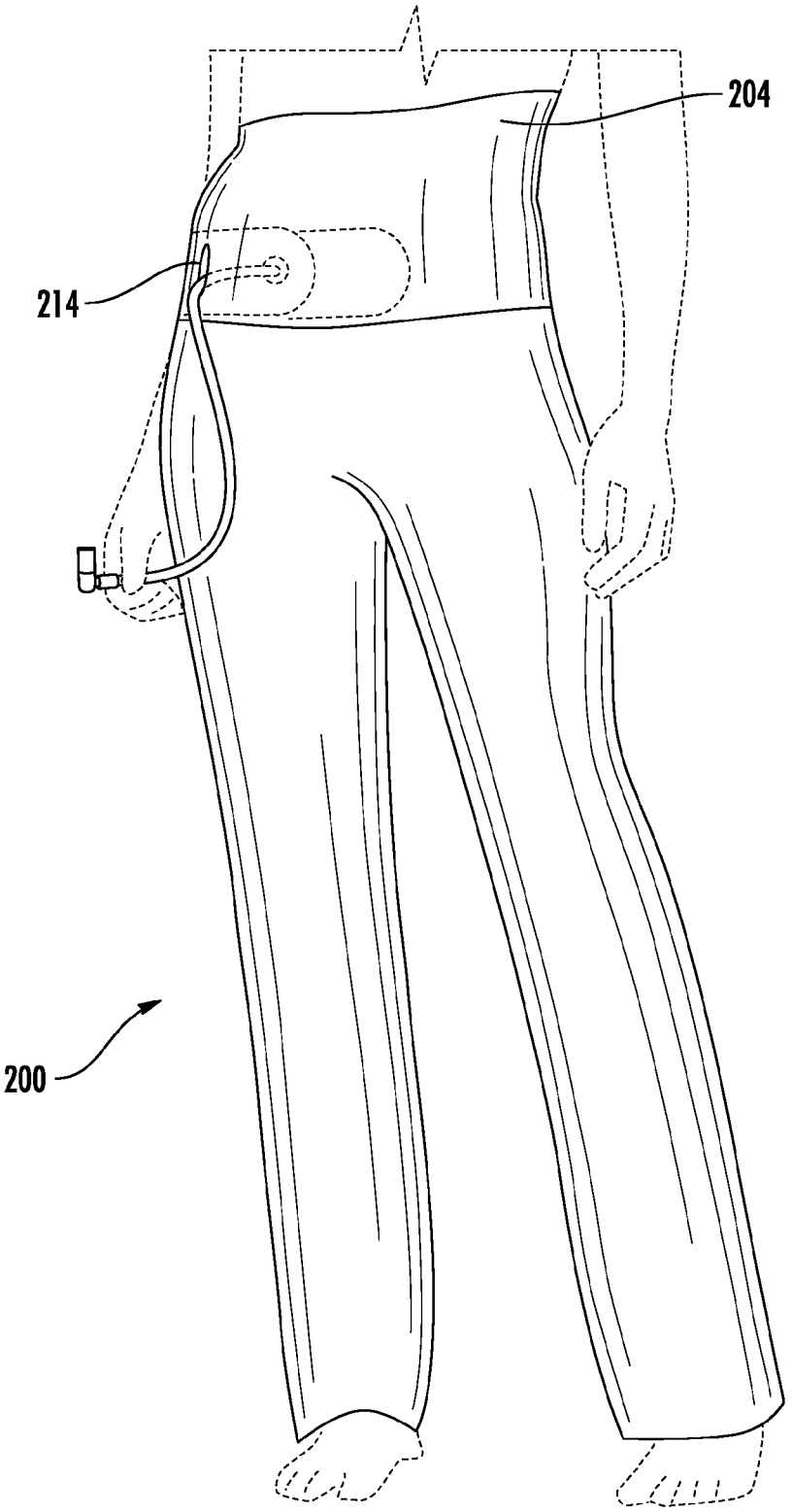

Referring now to FIGS. 2A and 2B, there is shown a STRAIGHT LEG version of an activewear garment 200 comprising a waistband pocket of the invention. Similar to other embodiments, garment 200 comprises a body portion 202 with a STRAIGHT LEG configuration terminating in leg apertures 212. In this embodiment, the waistband 204 is about 4 inches in width to accommodate an annular pocket of about 2 inches in width. At aperture 210, in this embodiment, the upper portion of the waistband 204, which upper portion is also about 2 inches in width, is folded down (FIG. 2A) to hide the pocket slit and extended (FIG. 2B) to show a vertical pocket slit 214. As shown in FIG. 2B, there is no horizontal seam dividing the waistband 204 into smaller sections, thus, the waistband pocket in this embodiment is the total width of waistband 204, or 4 inches. These larger compartments are useful for stowing and carrying personal items such as a bladder for holding water for the wearer of garment 200 to be able to drink while on the go. As shown, the bladder can be inserted into the waistband of the garment 200 through opening 214 and held in place by the elasticity of the waistband fabric alone or in combination with the opening being smaller than the bladder. Access to the water or other drink contained in the bladder can be provided by a tube connected with the bladder and which is conveniently disposed through opening 214 in a manner such that the user can drink from the tube or straw when desired. Having the bladder tucked away in the waistband of the pant provides great convenience for the user in not having to hold a water bottle instead.

Figure 3A:
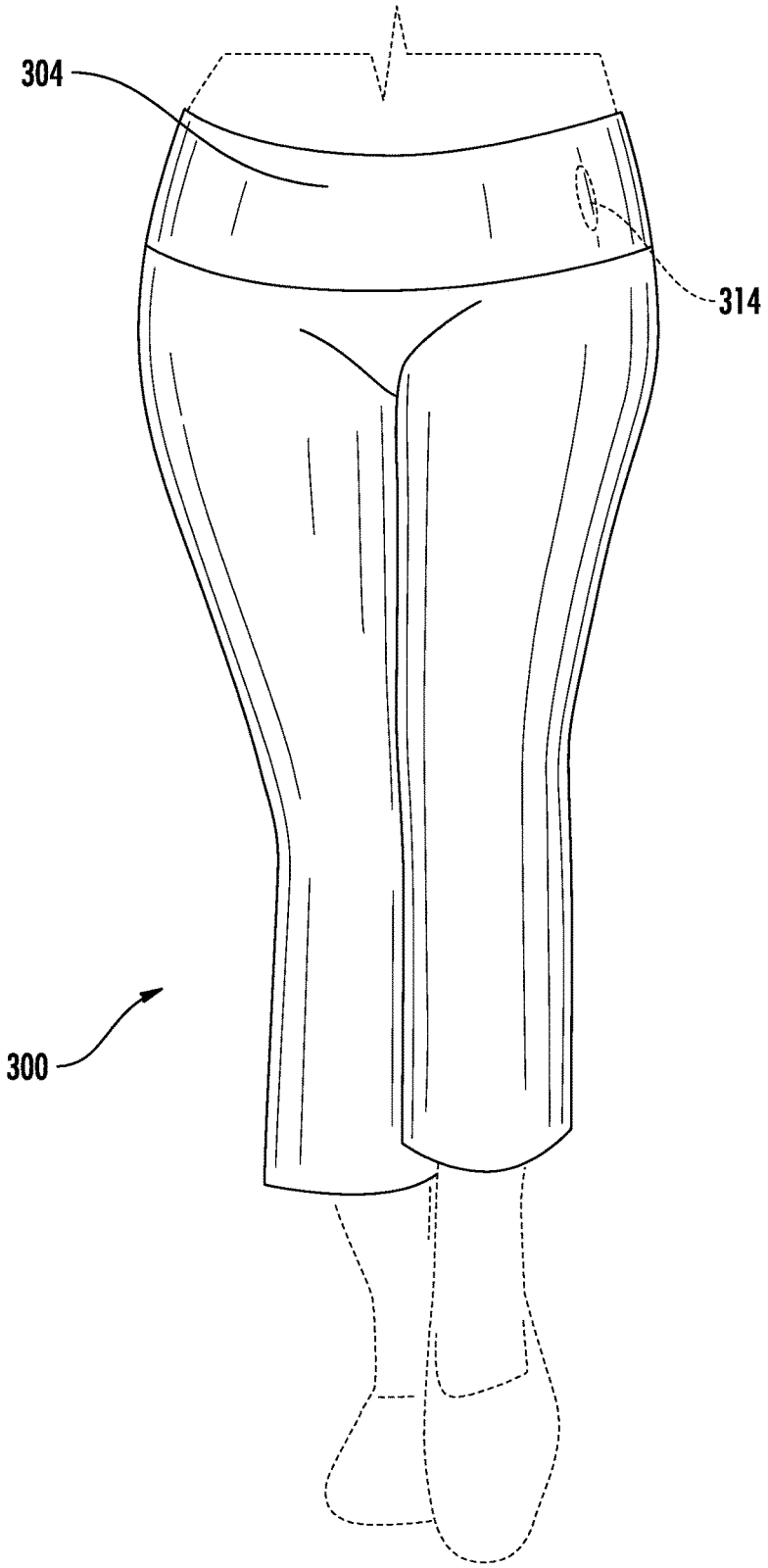
FIGS. 3A-B are schematic diagrams showing a CAPRIS BOOT CUT style pant of the invention comprising a waistband folded down to hide the pocket slit (FIG. 3A) and the waistband unfolded to reveal a vertical pocket slit on the left side of the pant (FIG. 3B).
Figure 3B:
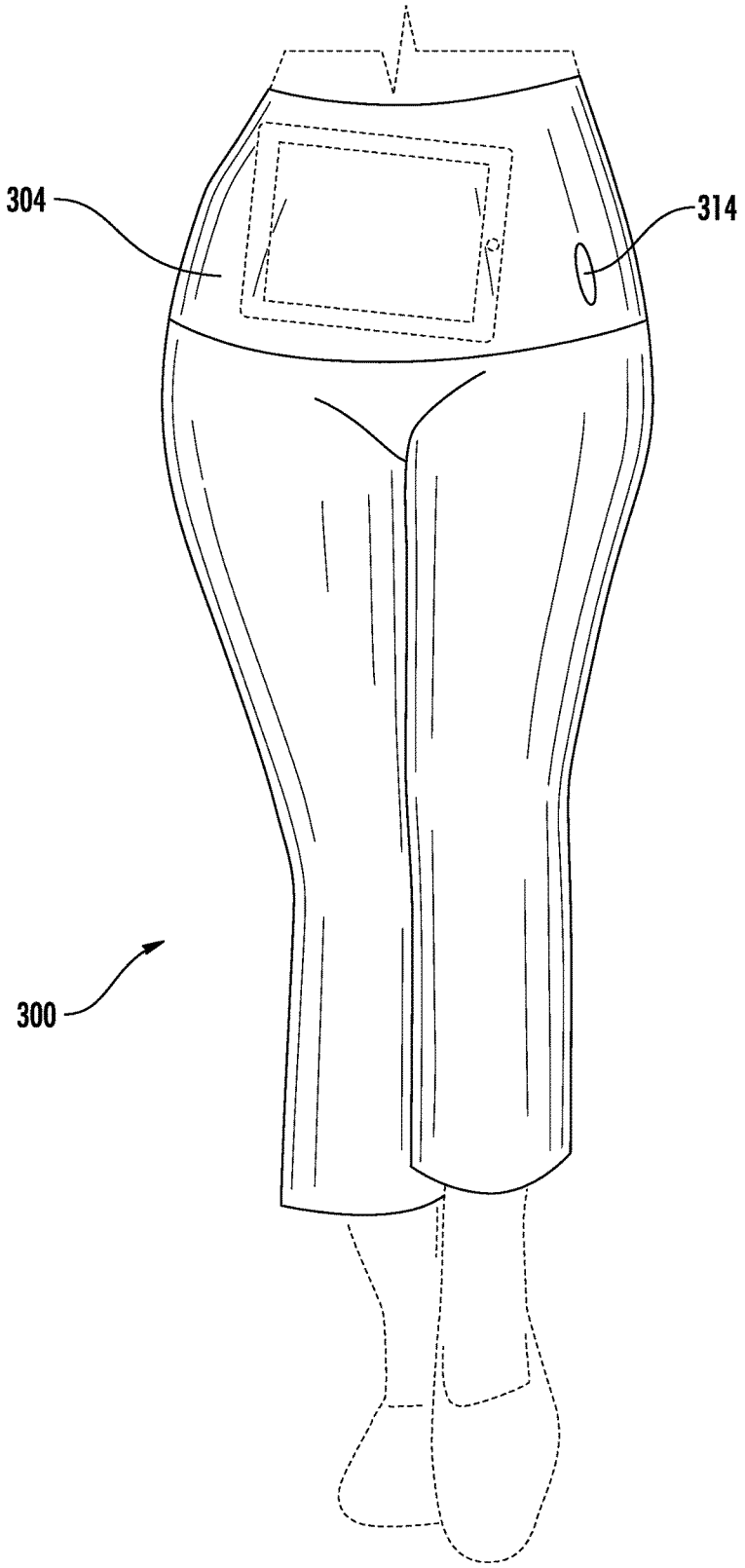

FIGS. 3A and 3B provide for a CAPRIS BOOT CUT leg version of the activewear garment 300 according to another embodiment of the invention. This version comprises a waistband 304 with a waistband pocket. As shown, the waistband 304 is about 3 inches in its folded over state (FIG. 3A) and about 6 inches when unfolded (FIG. 3B). There is no horizontal seam in the waistband 304 so the entire width of the waistband is available as a pocket. As shown, with a compartment of about 6 inches wide, the pocket is able to accommodate even larger items such as a tablet computer. During use, the tablet computer can be inserted into the pocket using openings 314, which are shaped, sized, and otherwise configured to allow for a tablet computer to be inserted into the garment 300 but also provide for retaining the tablet during use of the garment.

Figure 4A:
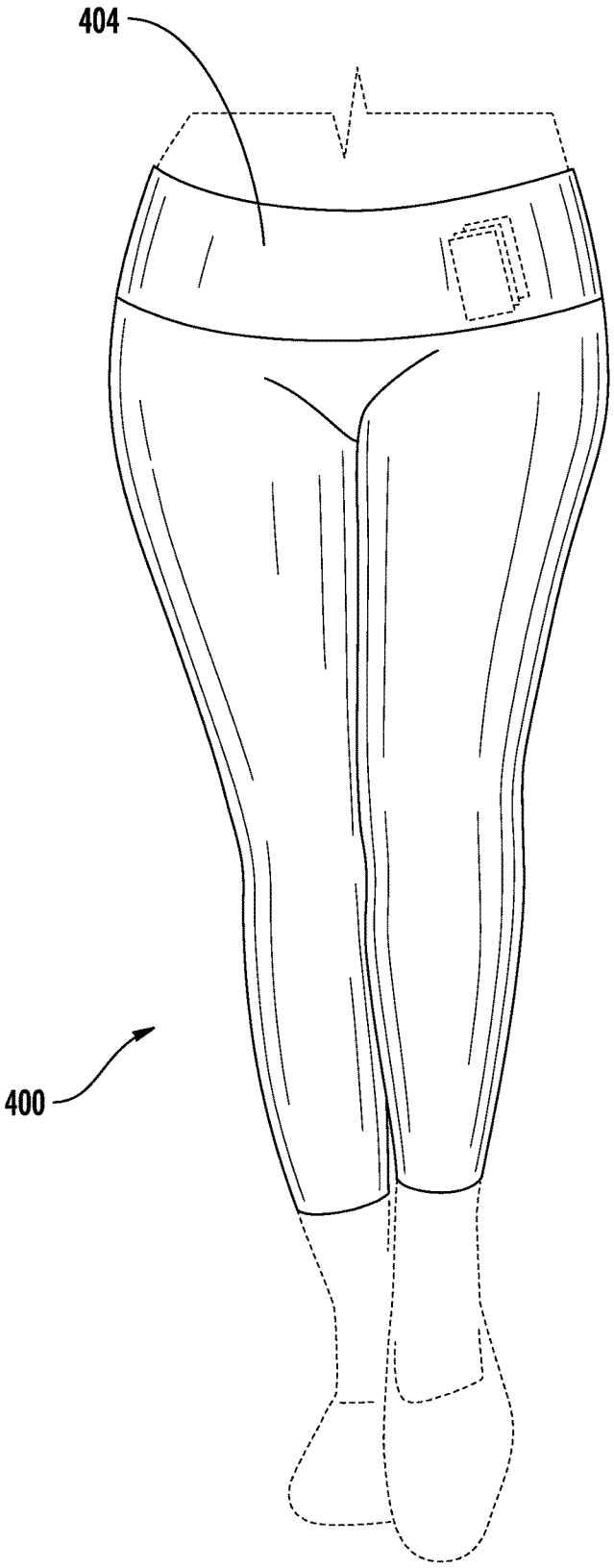
FIGS. 4A-B are schematic diagrams showing a CAPRIS STRAIGHT LEG style activewear embodiment of the invention comprising a waistband folded down to hide the pocket slit (FIG. 4A) and the waistband unfolded to reveal a vertical pocket slit on the left side of the pant (FIG. 4B).
Figure 4B:
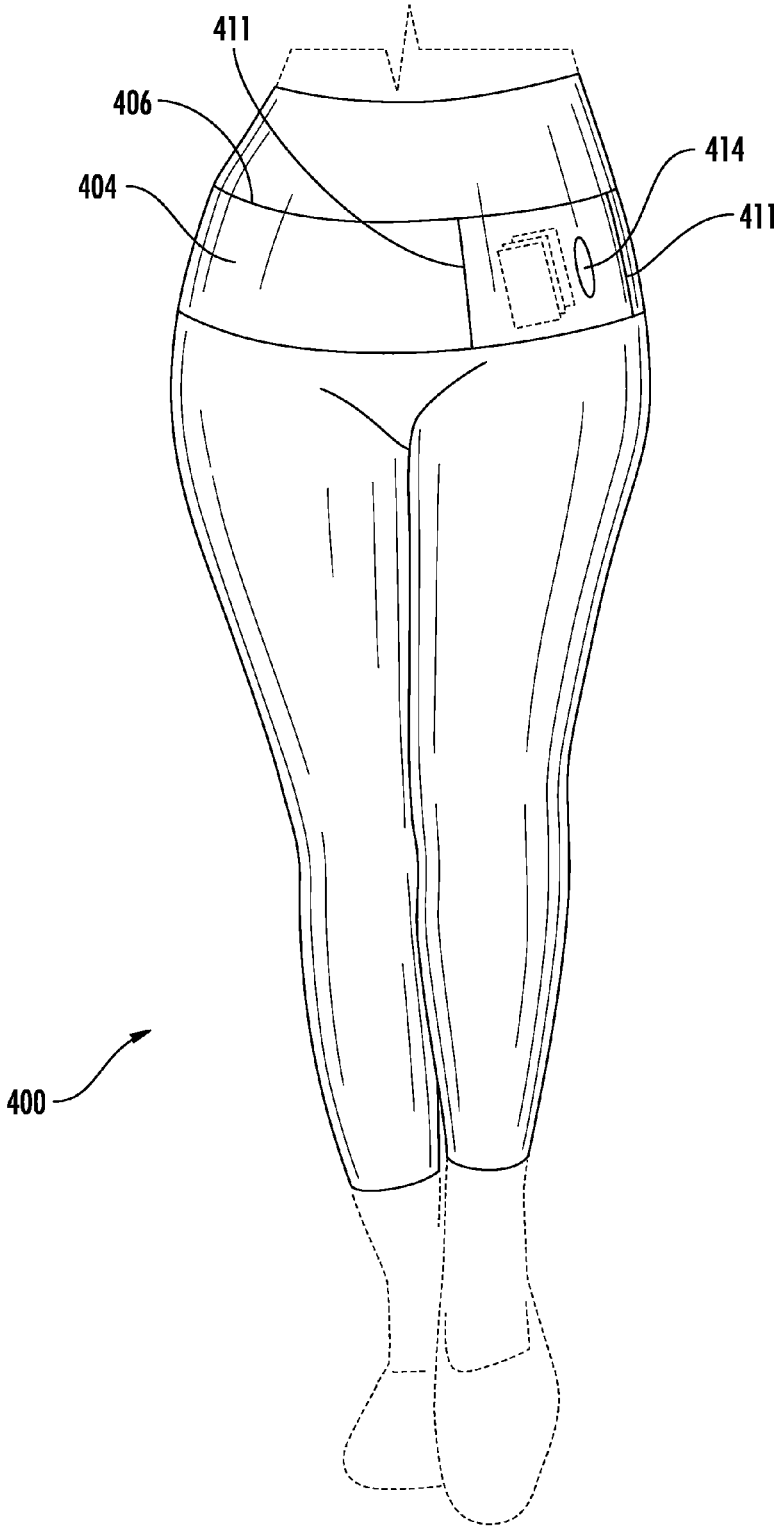

FIGS. 4A and 4B show a CAPRIS STRAIGHT LEG version of an embodiment of the invention which is an activewear garment 400. This embodiment has a 5 inch waistband where 2.5 inches can be folded over (FIG. 4A) to conceal the pocket opening, or unfolded (FIG. 4B) to reveal the opening, such as for inserting items into the waistband pocket. As shown, personal items such as business cards can be held safely and securely within the pocket. In this embodiment, the waistband 404 is divided by a horizontal seam 406 to provide a pocket that comprises only the lower half of the waistband 404. In addition, two vertical seams 411 are provided one on each side of pocket opening 414. The vertical seams 411 can be any number, can be disposed at any location around the waistband 404, can be oriented in any direction, can be any shape or size, and can be provided to such that a desired pocket size and shape is incorporated into the waistband 404. In this embodiment, business cards are placed in and retained within the waistband pocket. The smaller segregated pocket provides for the business cards to stay put once inserted into the waistband instead or migrating around the waistband as perhaps might happen with a larger pocket.

Figure 5A:
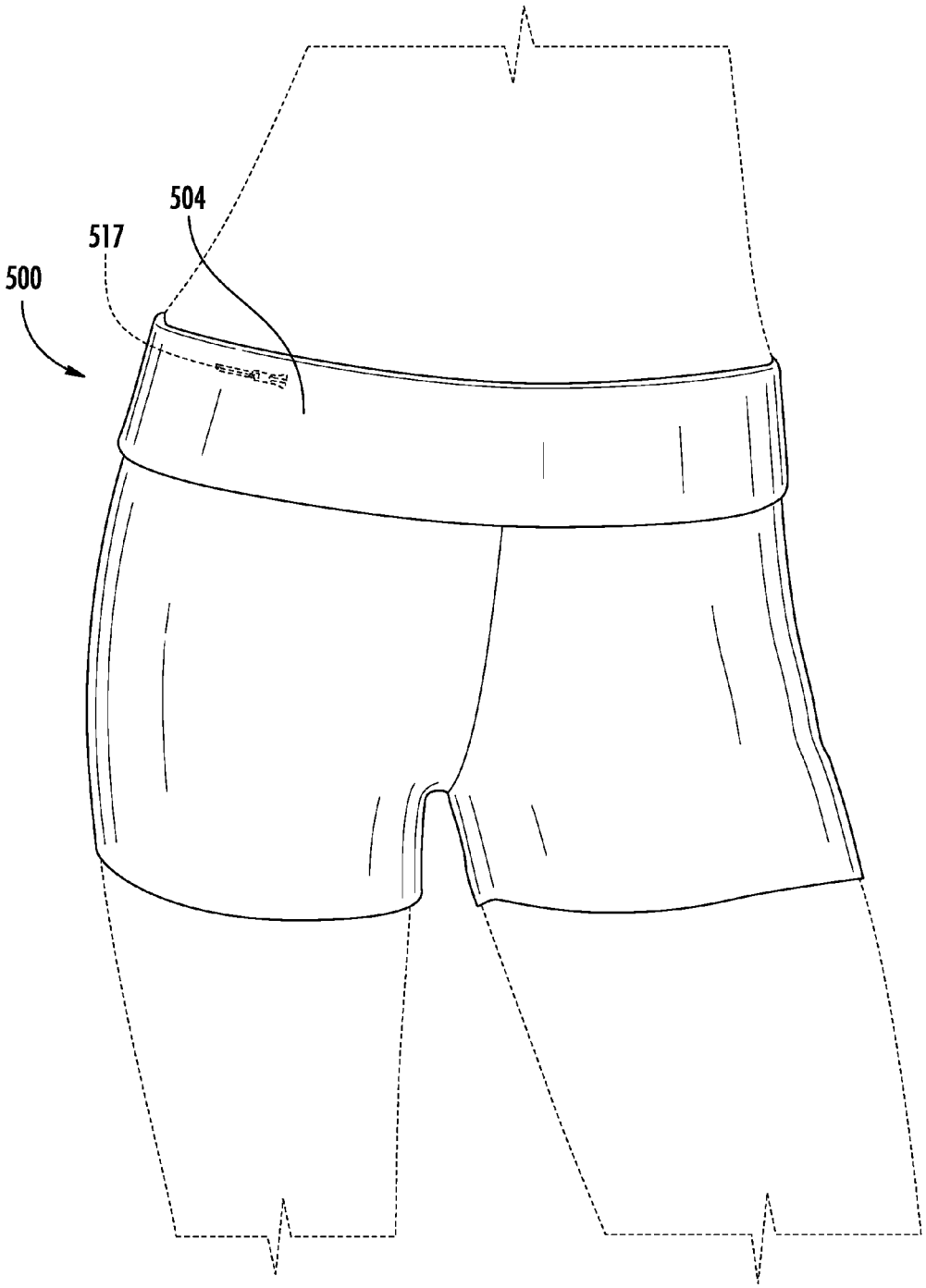
FIGS. 5A-B are schematic diagrams showing a FORM FITTING RUNNING SHORT style activewear embodiment of the invention comprising a waistband folded down to hide the pocket slit (FIG. 5A) and the waistband unfolded to reveal a horizontal pocket slit on the right side of the pant (FIG. 5B).
Figure 5B:
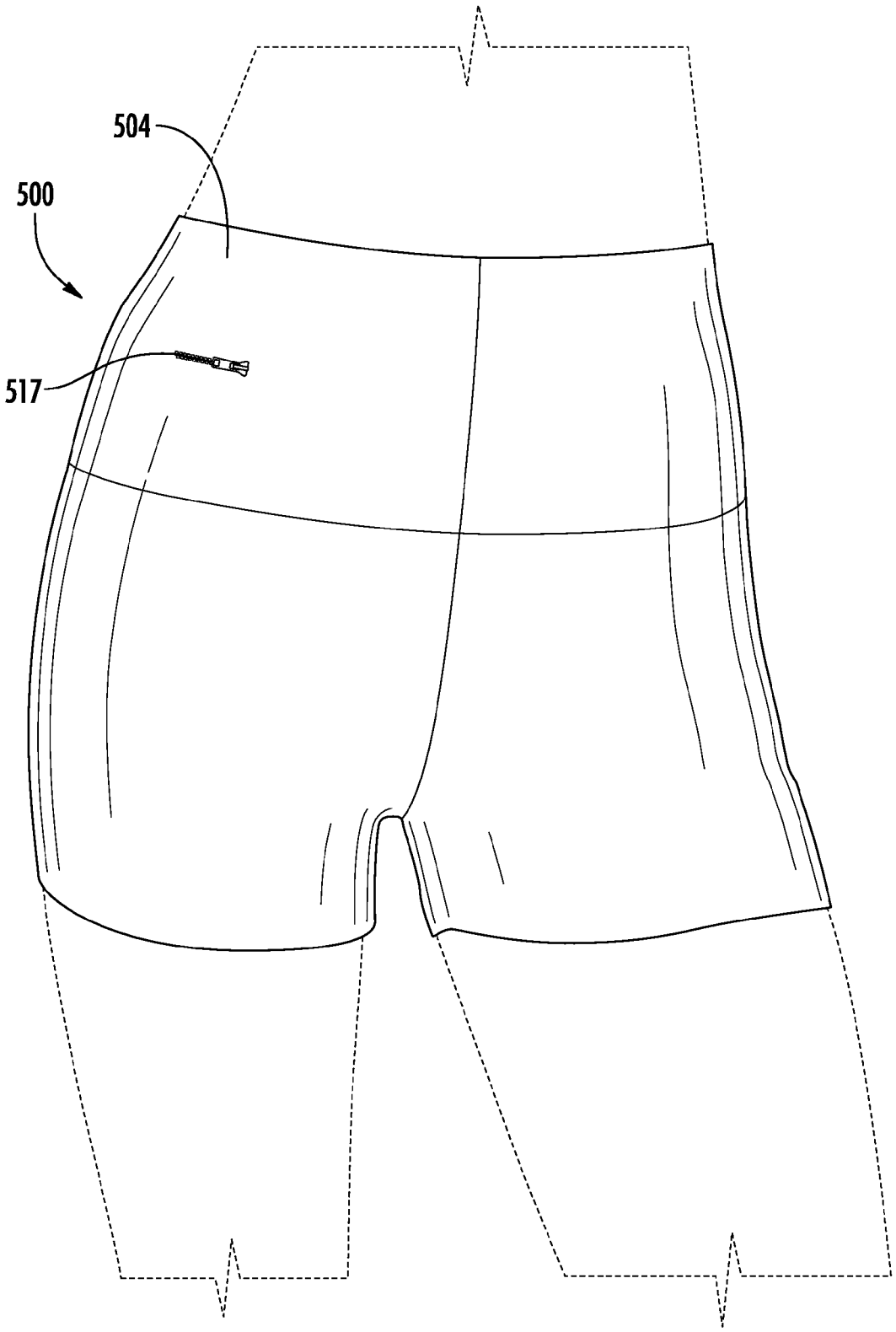

FIGS. 5A and 5B provide a TIGHT SHORT version of the garment 500 comprising a waistband pocket. This embodiment has a 4 inch waistband 504 folded down to a width of about 2 inches to hide the pocket opening (FIG. 5A), which can also be unfolded (FIG. 5B) to show a horizontal 517 zippered opening for accessing the pocket. As shown, the pocket opening 517 can comprise any type of closure, with preferred closures including laces, a zipper, button(s), Velcro, or snaps. A flap to cover the opening can also be incorporated into the garment 500, but preferred are pocket openings with no additional fabric, such as a pocket flap. For example, in embodiments where the waistband is constructed of multiple pieces of fabric sewn together at seams, such as six pieces of fabric sewn together, two of the pieces of fabric can be disposed as flaps. More specifically, a waistband can comprise a first piece of fabric that constitutes a front exterior facing panel of the waistband and which is sewn over a second longer piece of fabric. The second longer piece of fabric constitutes an interior facing panel of the waistband and contacts the user's body during use. The difference in length between the first piece of fabric and the second piece of fabric provides for an opening into the pocket formed by the first and second piece of fabric. The same configuration is provided on the back side of the waistband with a third and fourth piece of fabric. A flap can be provided on one or both of the front and back of the waistband to cover one or both of the pocket openings. In such embodiments, one or more flaps are provided by a fifth and six piece of fabric. The fifth piece of fabric is a flap sewn over the second piece of fabric and under the first piece of fabric, such that the flap covers the second piece of fabric, provides access to the pocket opening in the front of the waistband, and forms part of the exterior facing portion of the front panel of the waistband. Similarly, the sixth piece of fabric is a flap sewn over the fourth piece of fabric and under the third piece of fabric, such that the flap covers the fourth piece of fabric, provides access to the pocket opening in the back of the waistband, and forms part of the exterior facing portion of the back panel of the waistband.

Figure 6A:
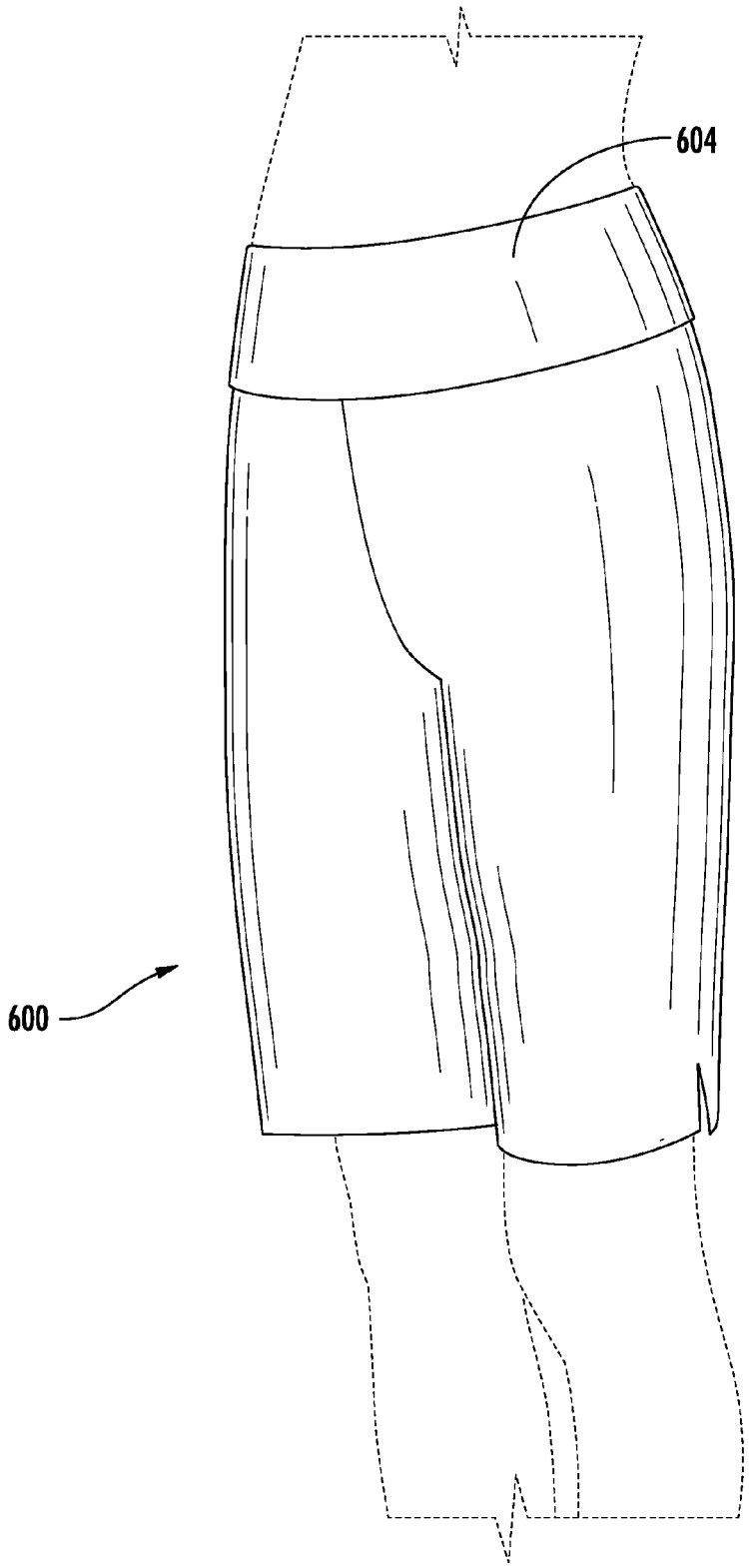
FIGS. 6A-B are schematic diagrams of a LOOSE SHORT embodiment of the invention comprising a waistband folded down to hide multiple pocket slits (FIG. 6A) and the waistband unfolded to reveal pocket slits on the left and right sides of the short (FIG. 6B).
Figure 6B:
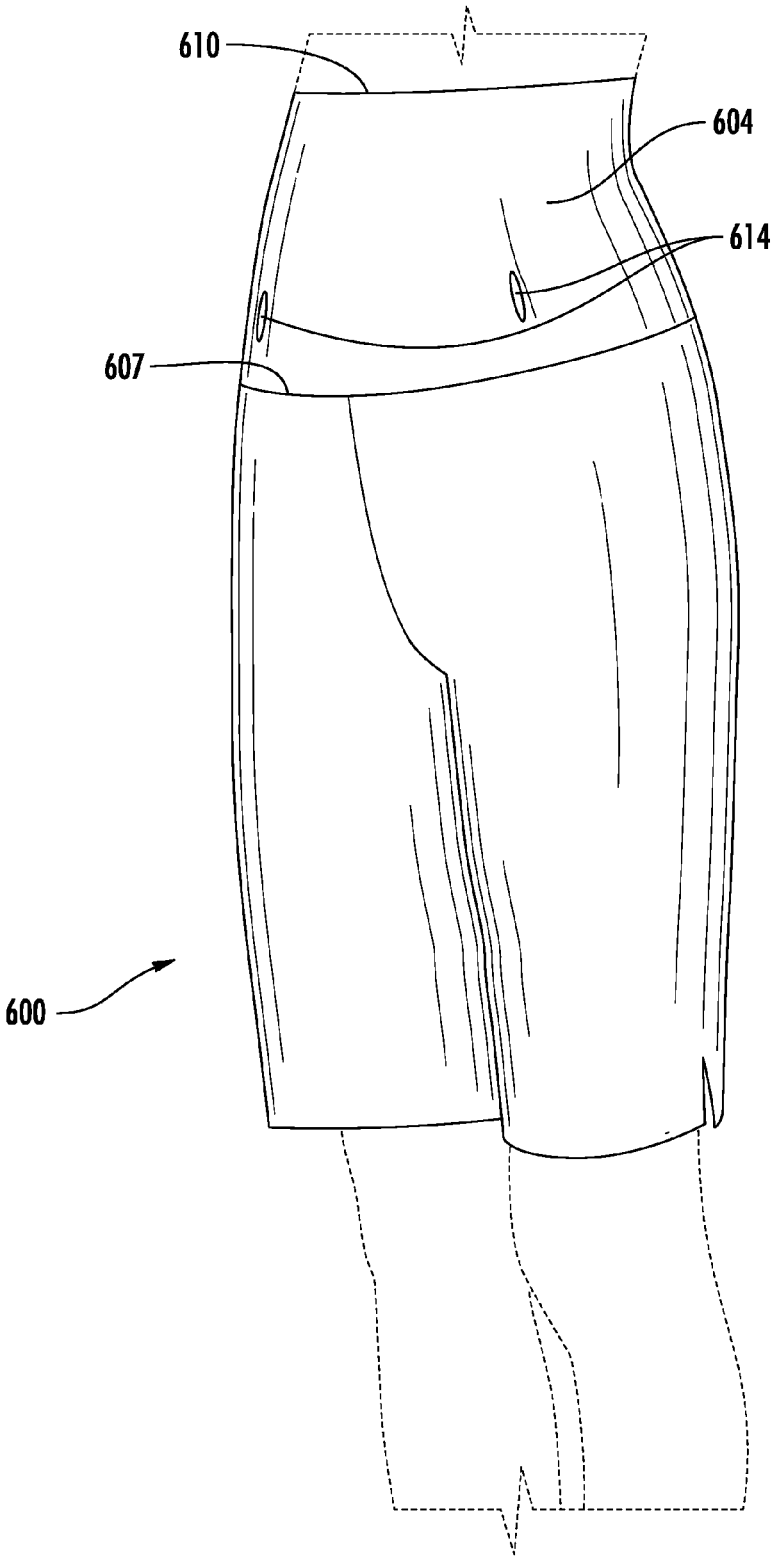

FIGS. 6A and 6B show a LOOSE SHORT version of activewear garments 600 according to embodiments of the invention. This activewear garment 600 comprises a 5 inch waistband 604, which can be folded down (FIG. 6A) to hide the pocket opening(s) or can be extended (FIG. 6B) to an open state to expose vertical pocket openings 614 on both the right and the left side of the waistband 604. Here, the height of the openings is about 5-25% of the height of the entire waistband (i.e., a vertical distance from torso opening 610 to seam 607). In embodiments, the height of the pocket openings 614 can be any height ranging from above 0% to just below 100% of the height of waistband 604, such as about 8-20%, or from about 10-18%.

Figure 7A:
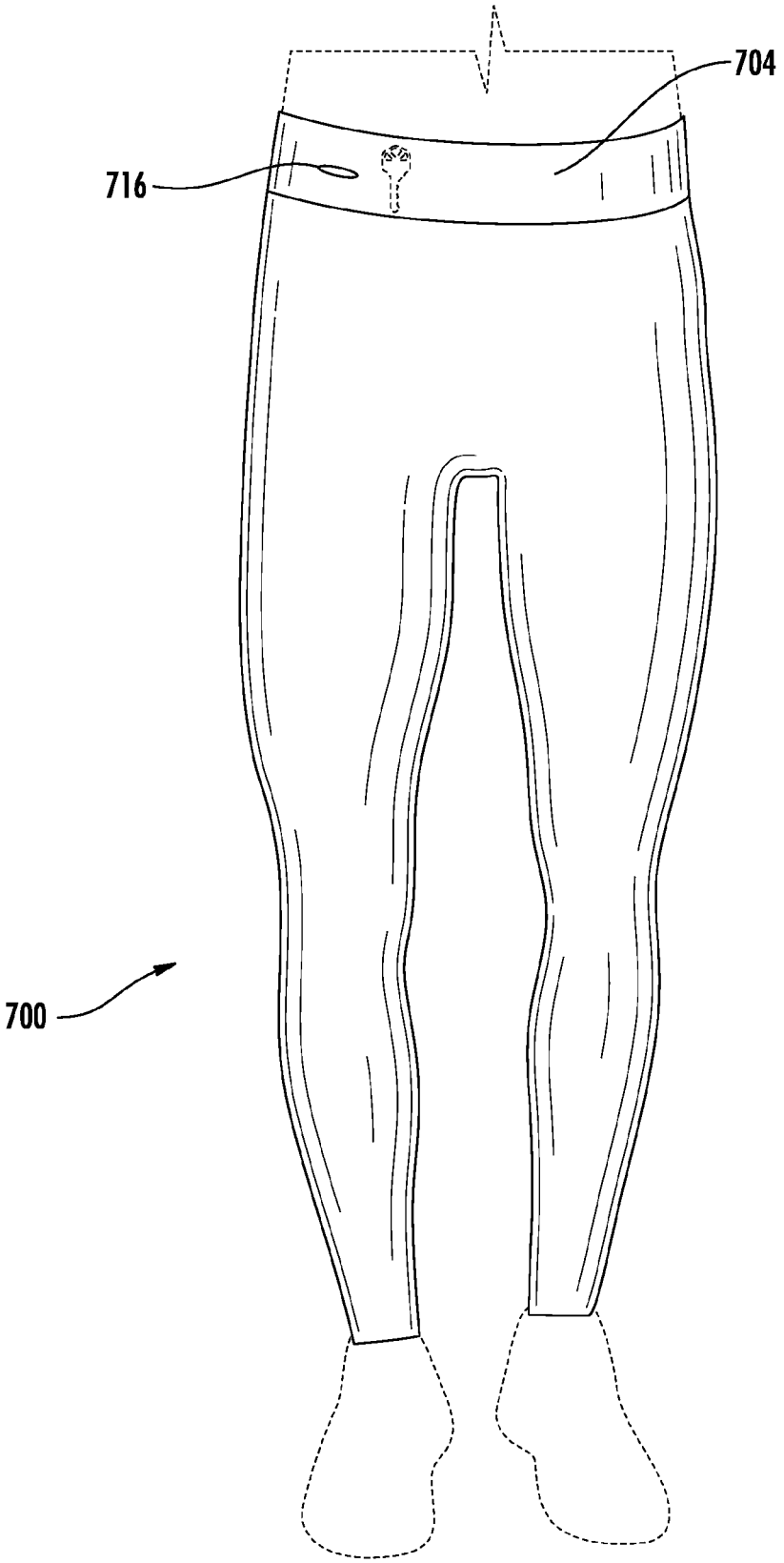
FIGS. 7A-D are schematic diagrams of a MEN'S RUNNING TIGHT style pant of the invention with an annular waistband pocket comprising a horizontal pocket opening on the right side (FIG. 7A); a horizontal pocket opening on the left side (FIG. 7B); different sized vertical pocket openings on the left and right sides (FIG. 7C); and finished pocket openings on the left and right sides (FIG. 7D), including a cross-sectional view of a pocket opening (FIG. 7E).
Figure 7B:
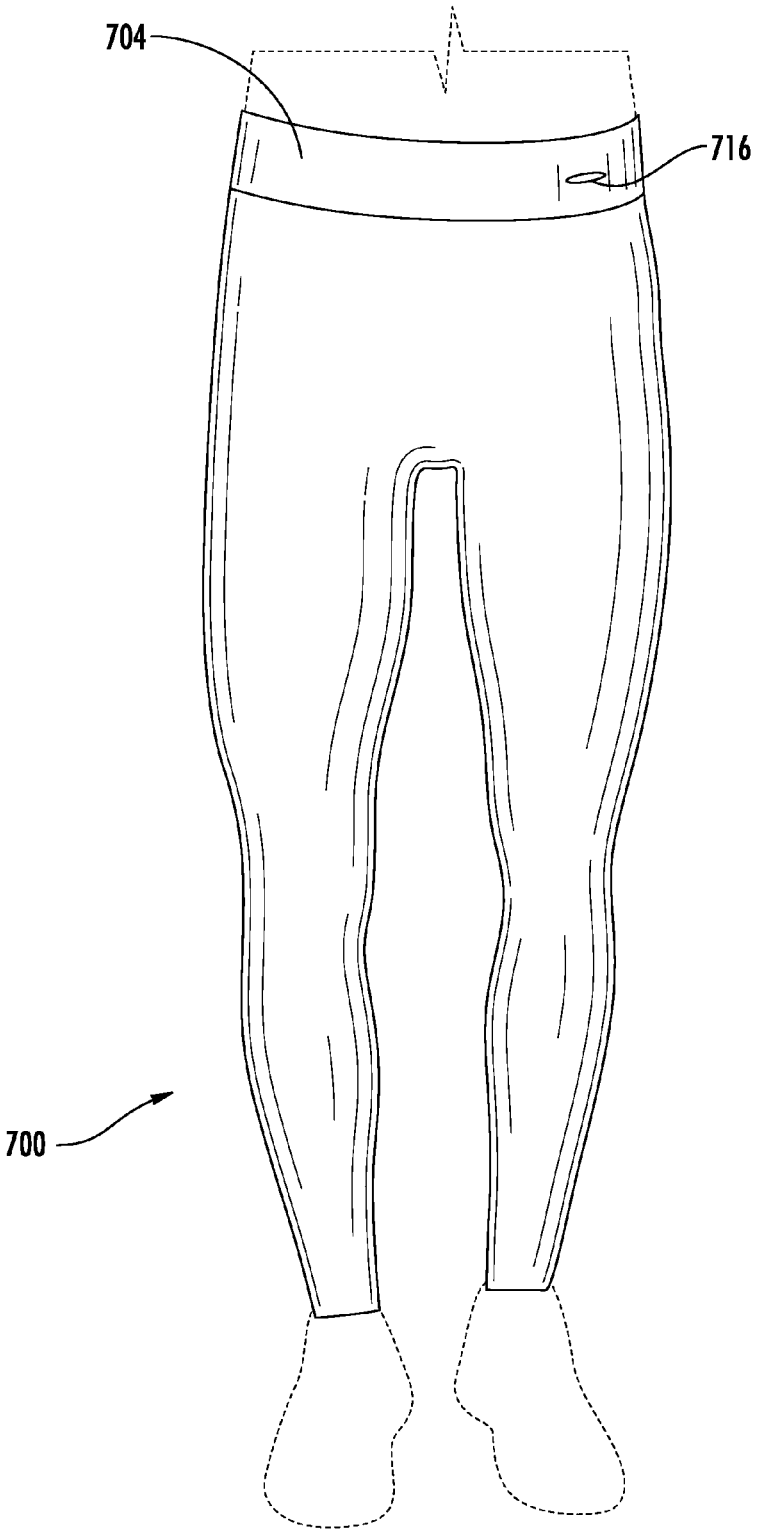
Figure 7C:
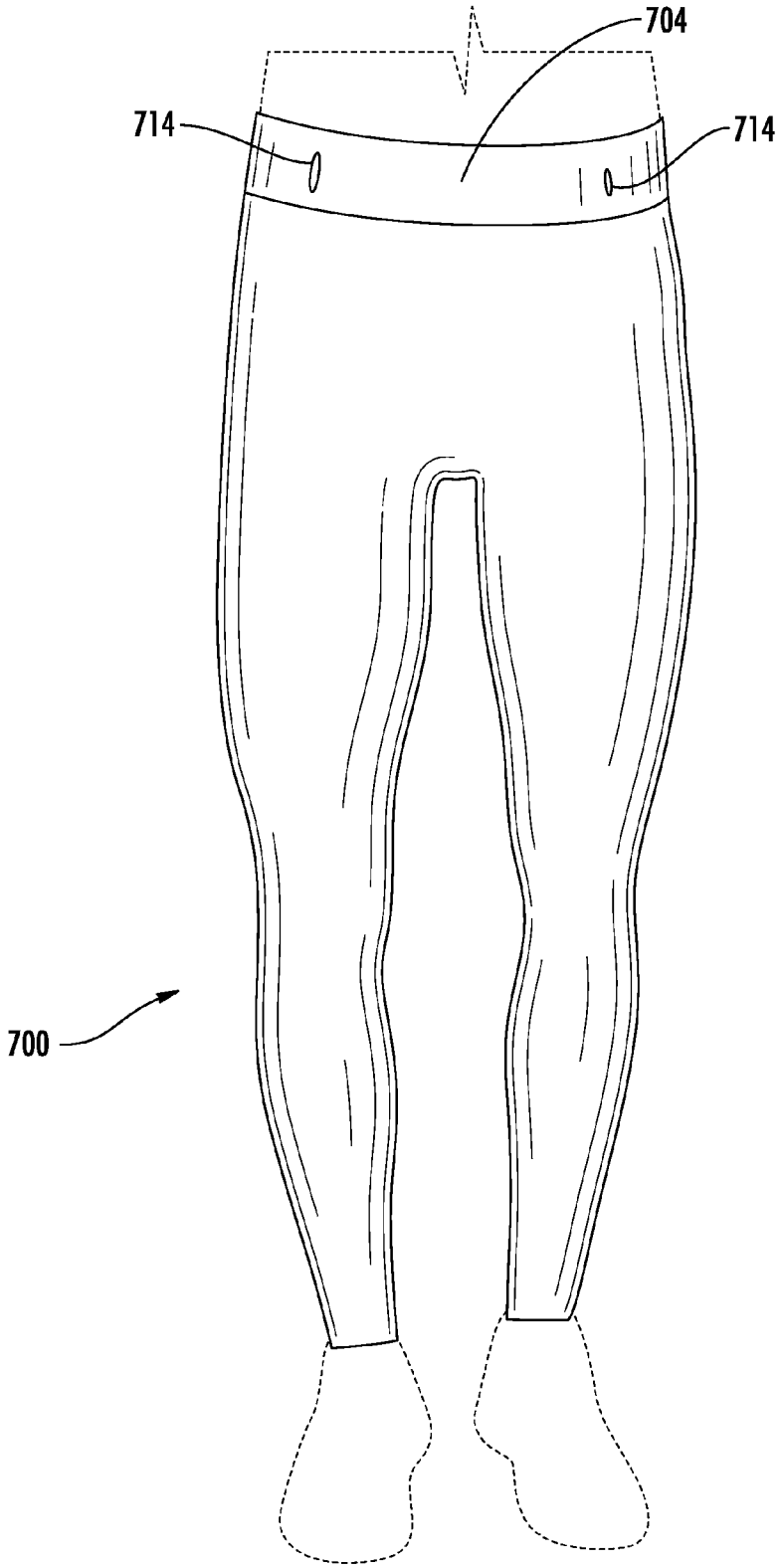
Figure 7D:
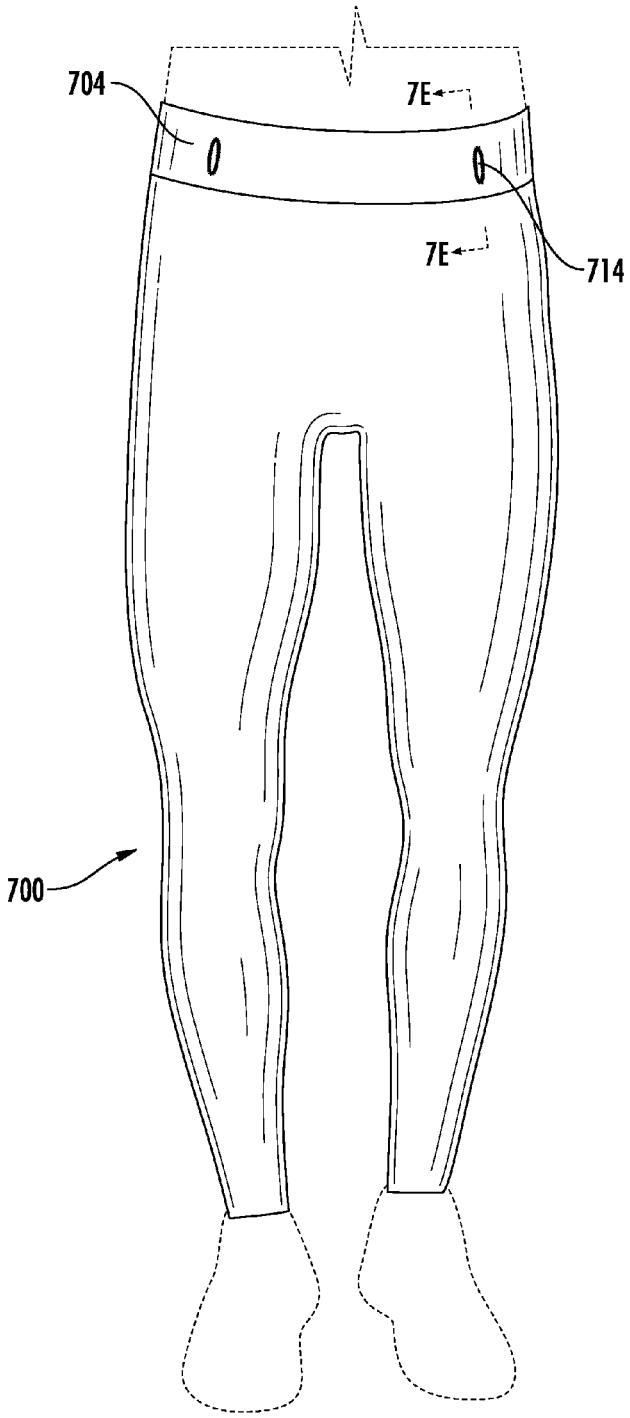

Activewear of embodiments of the invention can include garments for men. FIGS. 7A-D illustrate representative activewear for men that includes a STRAIGHT LEG version of garment 700. This straight leg RUNNING PANT style comprises a waistband 704 with a waistband pocket for holding personal items such as keys as shown. A horizontal slit 716 type opening is provided for access to the pocket interior. This embodiment comprises a 2 inch waistband 704. The waistband can be folded over, however, to most users of this style pant it is not intended to fold the waistband over. Accordingly, the pocket opening 716 is exposed. As shown in FIG. 7A, the pocket opening 716 can be a horizontal opening and can be left open with an unfinished opening, or the pocket access can be open with a finished opening, or a closure can be included to open and close the pocket access as desired. As demonstrated in FIGS. 7A-B, the pocket opening 716 can be on the left or right side of the pant. As demonstrated in FIG. 7C, different sized vertical openings 714 can be disposed at any position on the waistband 704. Alternatively, the different sized openings can also be horizontal openings or at least one horizontal opening and at least one vertical opening. Here, one of the openings has a height of between 40-90% of the waistband, while the other opening has a height ranging from about 20-50% of the height of the waistband. Alternatively, openings 714 can be the same size as shown in FIG. 7D. The openings 714, 716 can be finished or unfinished. As shown in the cross-sectional view FIG. 7E of the pocket, the openings 714 are preferably finished, button-hole type openings. The pocket can be annular in that it encircles the entire waistband 704 of the pant, or can be any size less than that length.

Figure 7E:
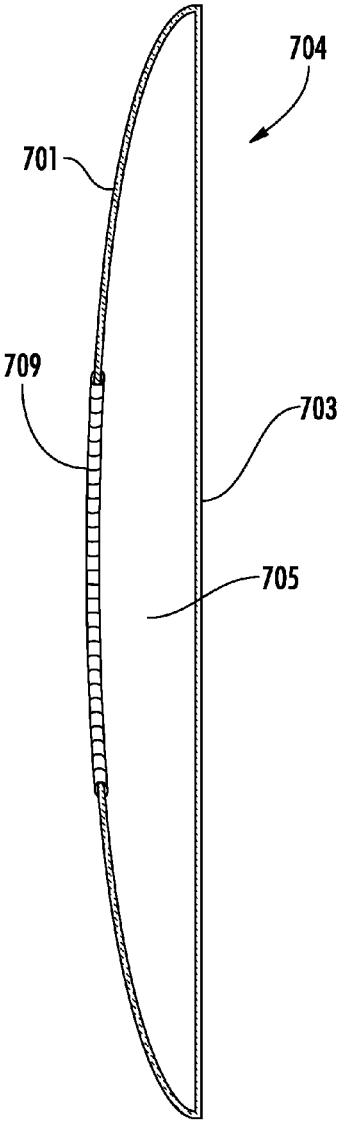

FIG. 7E provides additional detail about the pocket of waistband 704. More particularly, a cross-sectional view of the pocket is provided, which shows a cross section of the annular region defined by the pocket. As illustrated, pocket 705 can be formed from a single sheet of material folded over to provide for space between the folded sheet. The folded sheet comprises a front layer of material 701 and a back layer of material 703. When a garment containing the waistband pocket 705 is worn by a wearer in a typical manner, the back layer of material 703 is in contact with the waist of the wearer, while the front layer of material 701 will face outward and be seen by others. The finished opening 709 to the pocket 705 can be incorporated into the fabric at any point but is preferably introduced prior to partial formation of the waistband, or prior to complete formation of the waistband. For example, the finished openings 709 can be added to the sheet of fabric in a similar manner to button holes. Then the material can be joined at the elongated ends of the fabric to provide the sheet of fabric as a ring of material. The ring-like sheet of material can then be folded over on itself and sewn around the bottom elongated edges of the front 701 and back 703 layers to join the material and create an annular or tubular region between layers 701, 703. Alternatively or in addition, once the sheet of material is folded over, the sheet of material can be joined with the body portion of the garment along the elongated edge of the body portion as well. Sewing or joining these edges (the body portion edge, the front layer 701 edge, and the back layer 703 edge) together simultaneously may save on manufacturing steps and costs.

Figure 8A:
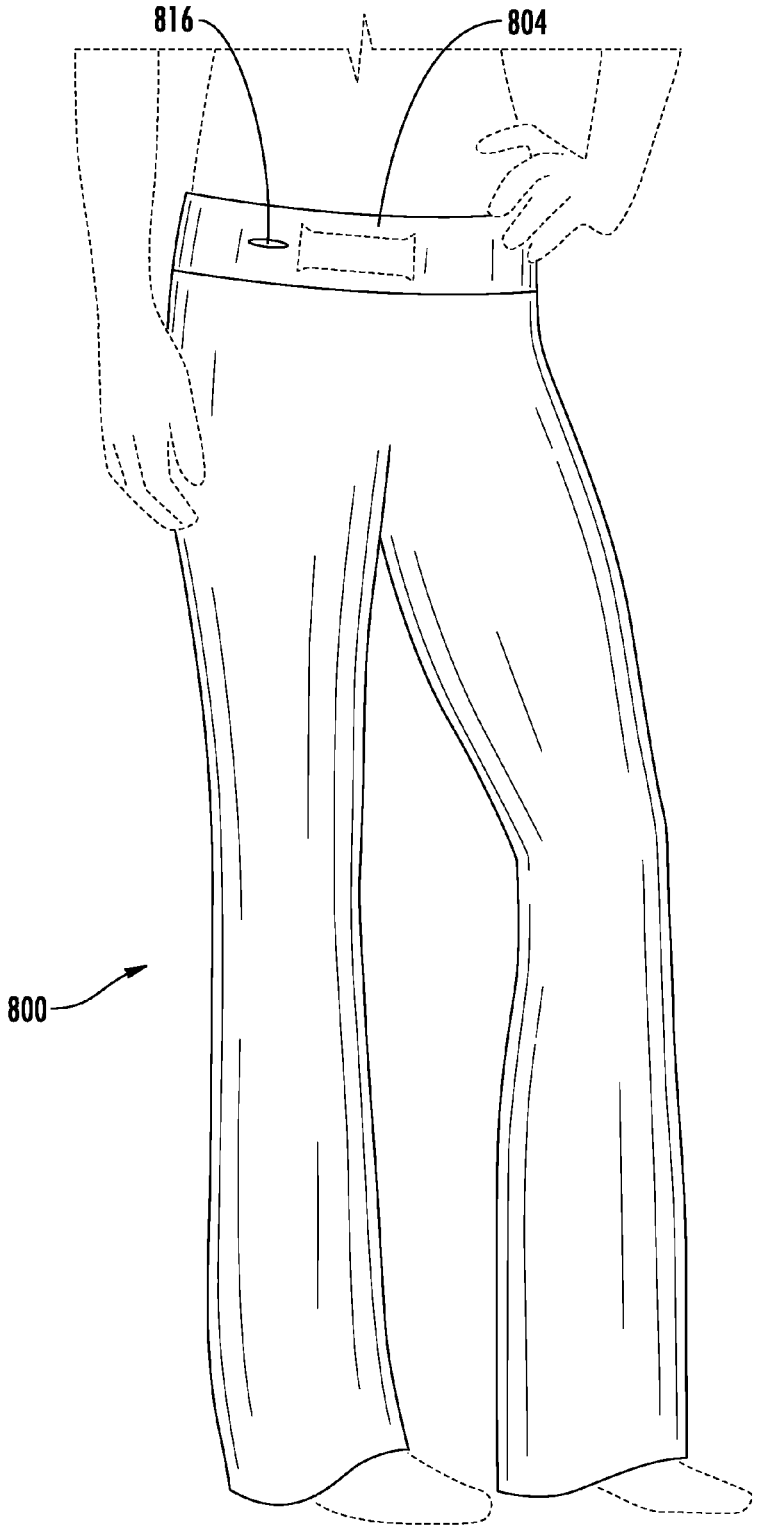
FIGS. 8A-B are schematic diagrams showing a BOOT CUT style activewear embodiment of the invention with a right-side horizontal pocket opening (FIG. 8A); and with a left-side horizontal pocket opening (FIG. 8B).
Figure 8B:
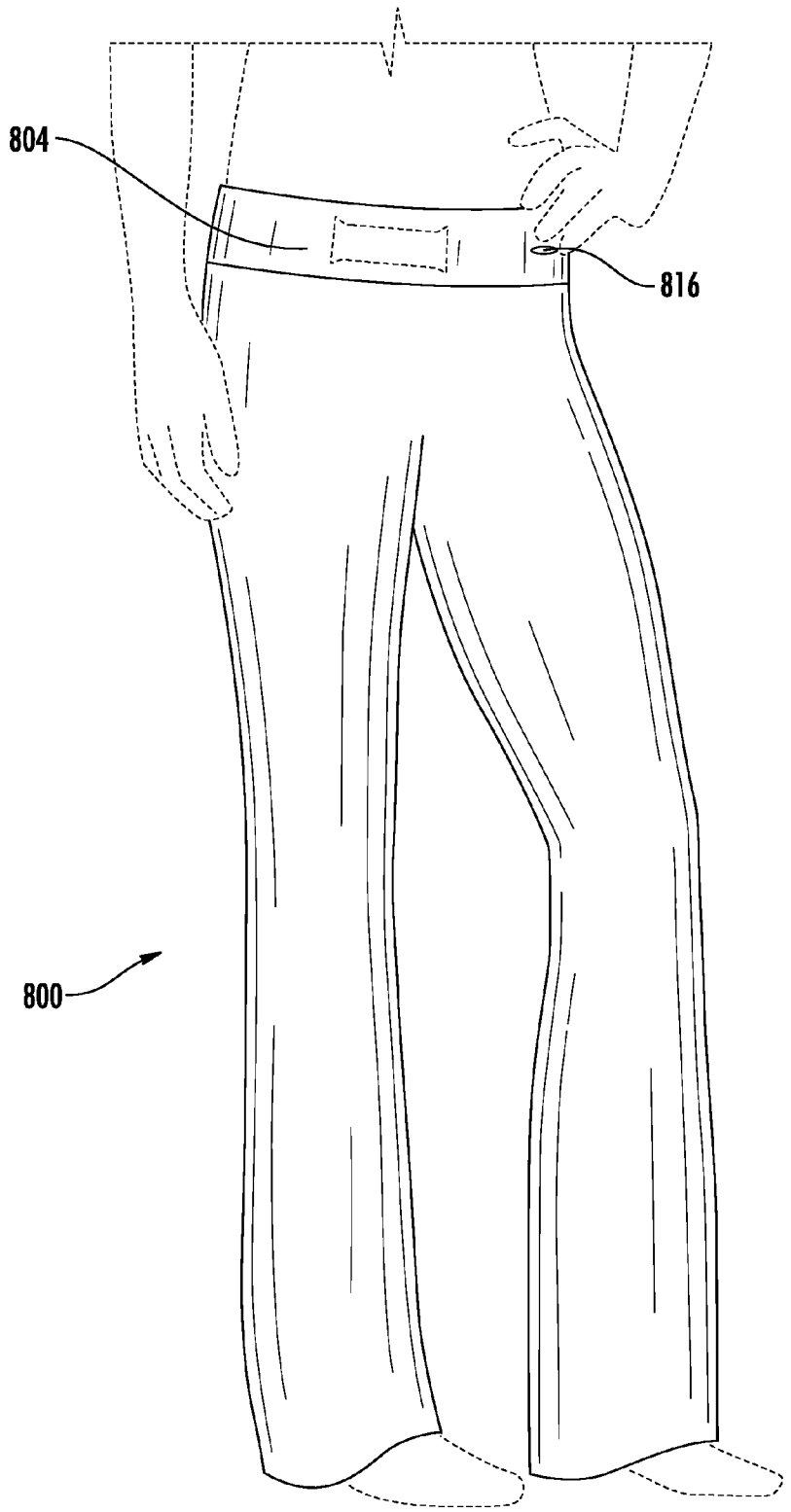

FIGS. 8A-B provide a RUNNING PANT with a BOOT CUT leg embodiment of the activewear according to the invention. As shown, such a pant can comprise a waistband 804 that is intended to remain in an unfolded state on the waist of the user. In such a configuration, the pocket opening 816 to the waistband pocket is exposed and thus visible to others. The horizontal pocket opening 816 in FIG. 8A is shown on the right side of the pant and has a width of about 30-60% of the height of the waistband. The horizontal pocket opening 816 in FIG. 8B is shown on the left side of the pant and has a width of about 10-50% of the height of the waistband. In the context of this specification it is important to note that when referring to the dimensions of the pocket opening either the width or height may be used. When referring to height, the pocket opening is usually disposed in a vertical position and when referring to width of the pocket opening the opening is typically disposed in a horizontal position. In either case, what is intended is referring to the largest dimension of the opening in a relaxed state. Because in preferred embodiments, the opening will be a cut in the fabric, such as a single slit, there will only be one dimension to the opening, which is also the length of the cut.

Figure 9:
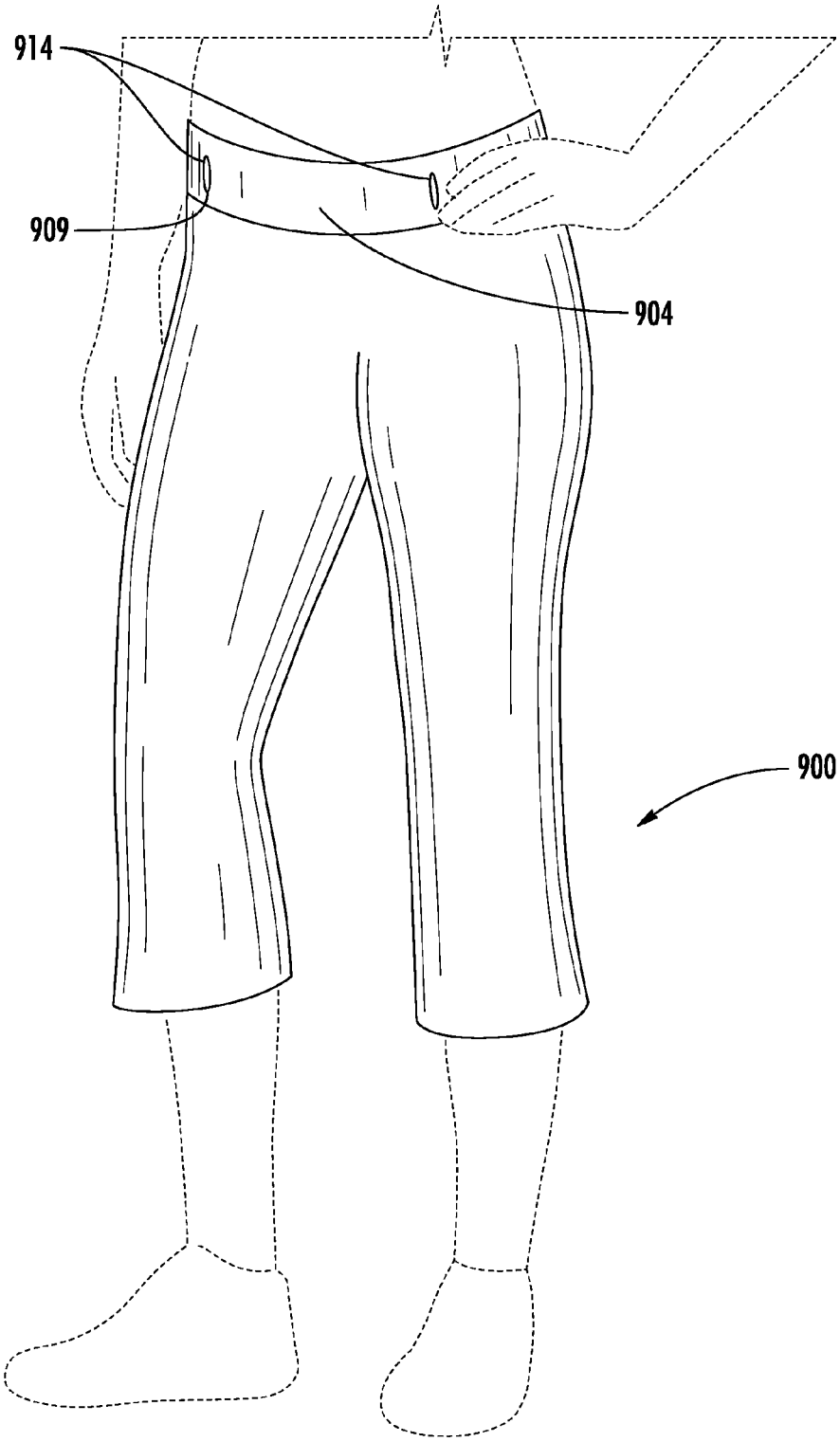
FIG. 9. is a schematic diagram of a CAPRIS BOOT CUT style pant of the invention showing multiple vertical pocket openings for a waistband pocket.

FIG. 9 is yet another activewear embodiment 900 of the present invention. This embodiment provides for a CAPRIS BOOT CUT style with a waistband pocket. Two vertical pocket openings 914 are provided for access to the pocket. One of the pocket openings 914 has an unfinished edge and the other opening has a finished edge 909. Any number of finished or unfinished edge openings 914 can be used. The waistband 904 in this configuration is about 1.5 inches wide/high, while the openings 914 are about 0.75-1.5 inches wide/high.

Figure 10:
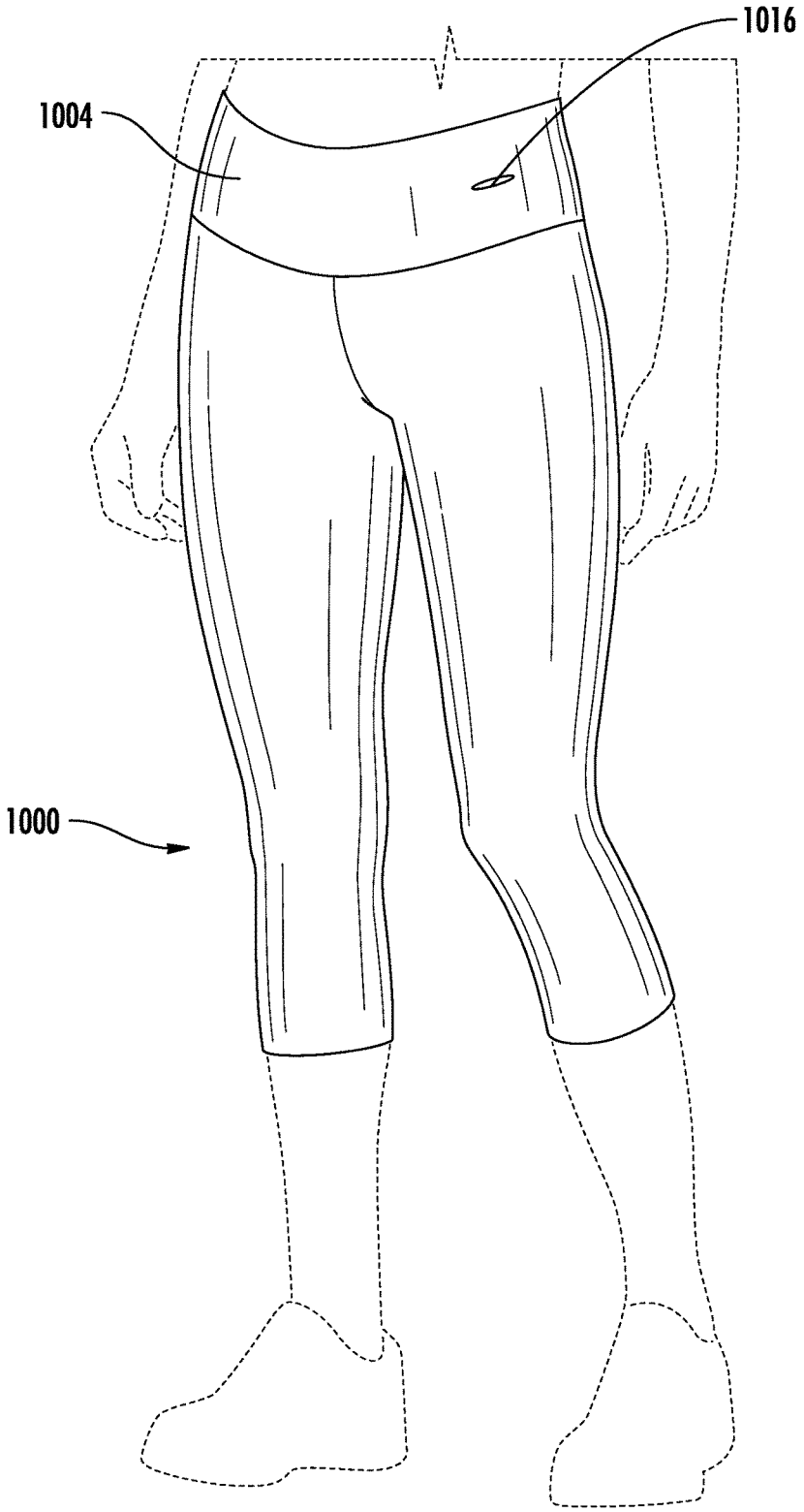
FIG. 10. is a schematic diagram of a CAPRIS STRAIGHT LEG style pant embodiment of the invention showing a waistband pocket with a left-side horizontal opening.
Figure 11:
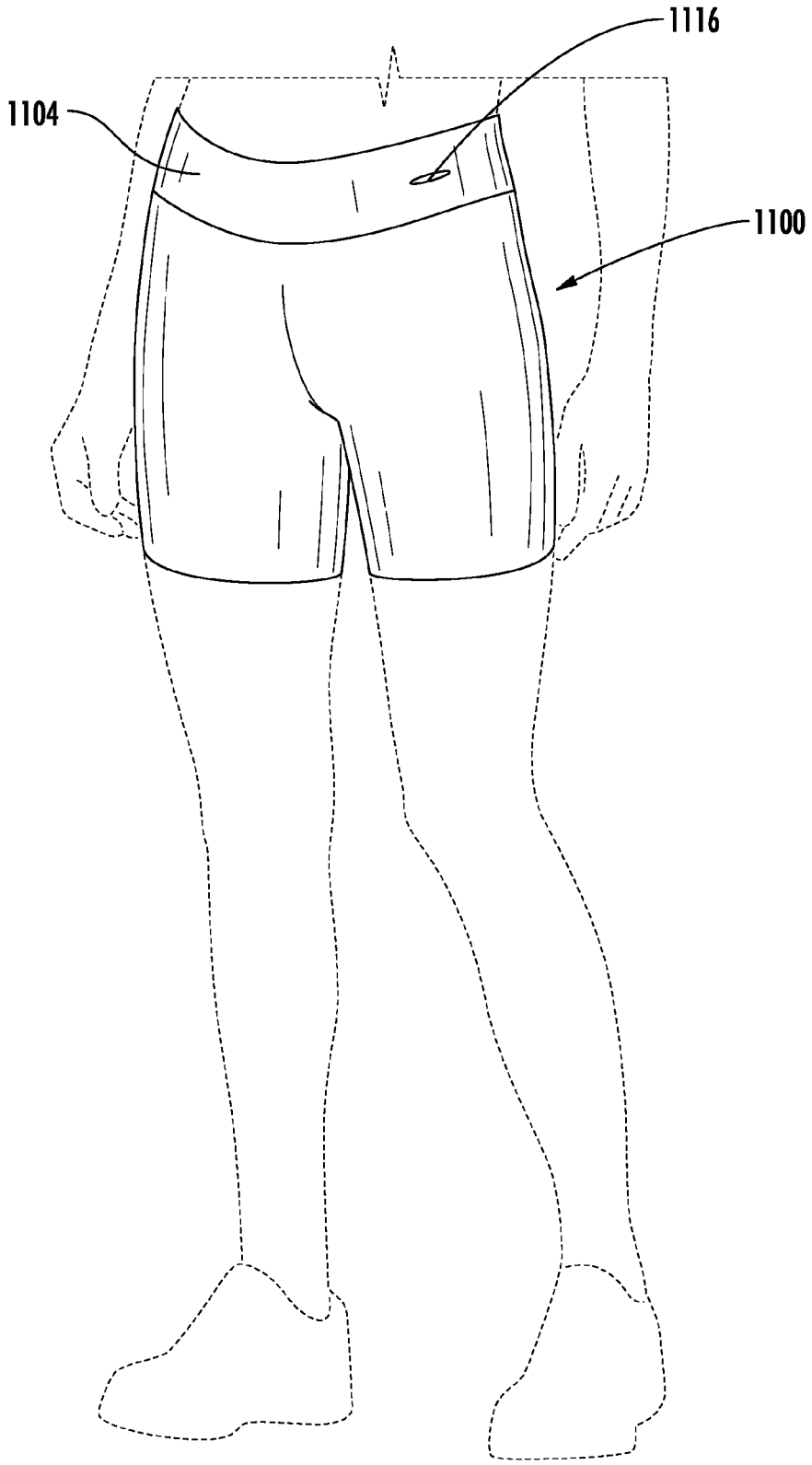
FIG. 11. is a schematic diagram of a FORM FITTING SHORT embodiment of the invention showing a waistband pocket with a left-side horizontal opening.
Figure 12:
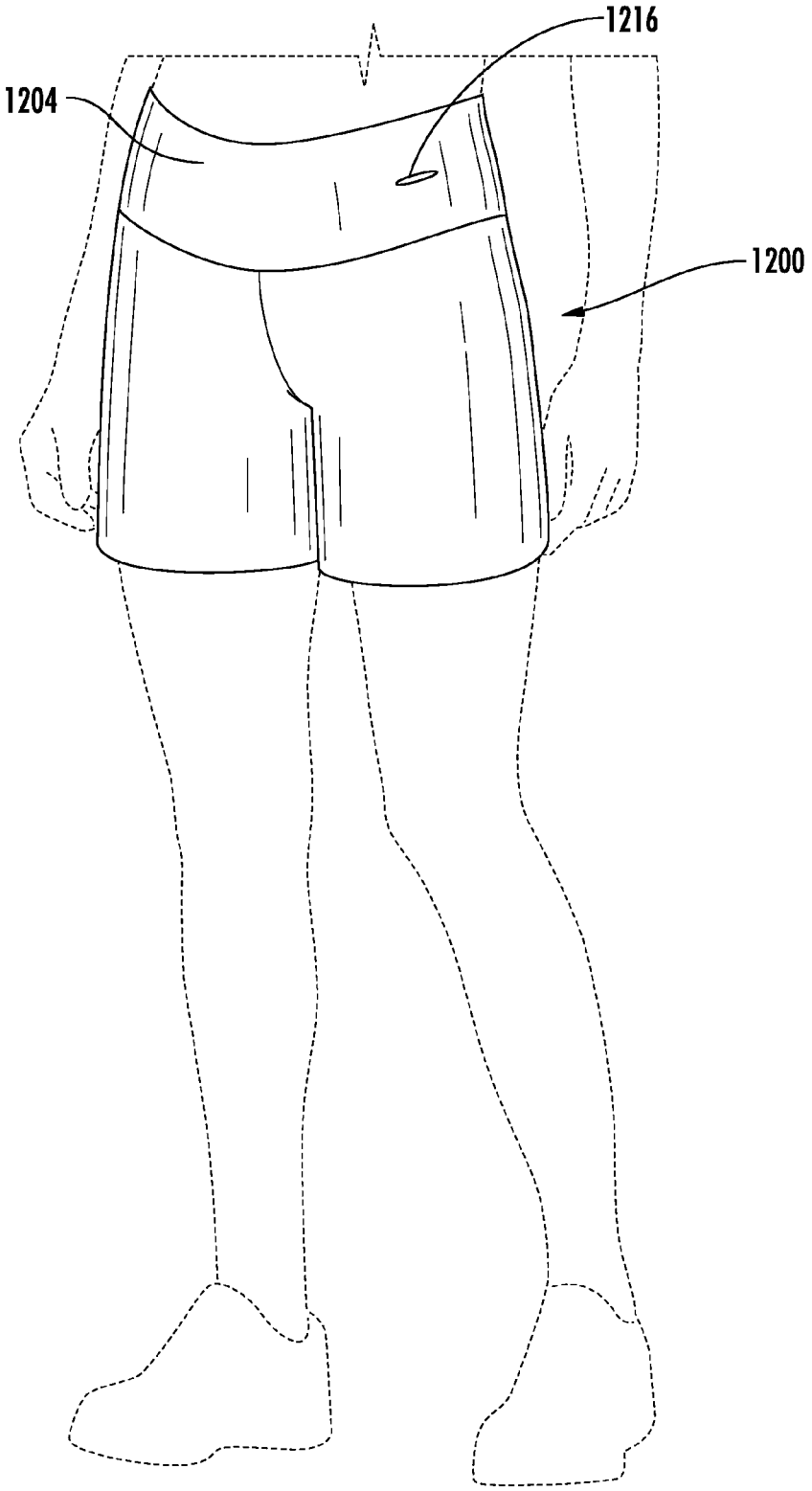
FIG. 12. is a schematic diagram of LOOSE SHORT style garment with a waistband pocket having a left-side horizontal opening.

FIG. 10. is a schematic diagram of a CAPRIS STRAIGHT LEG style pant 1000 embodiment of the invention showing a waistband pocket with a left-side horizontal opening. The waistband 1004 with left side 1-inch horizontal 1016 pocket slit is disposed within a 3-inch waistband 1004. FIG. 11. is a schematic diagram of a FORM FITTING SHORT 1100 embodiment of the invention showing a waistband 1104 with a waistband pocket having a left-side horizontal opening 1116. This pant comprises a 2-inch waistband with a 1-inch slit. FIG. 12 is a schematic diagram of a LOOSE SHORT 1200 style garment with a waistband pocket having a left-side horizontal opening 1216. As shown in FIG. 12, a 3-inch waistband 1204 comprises a 1-inch horizontal 1216 pocket slit. Although the various embodiments illustrated in this specification provide for a wide range of alternatives for the activewear inventive embodiments, other configurations and styles are also possible, such as for example, any garment having a waistband, including additionally shirts, skirts, and skorts.

Figure 13:
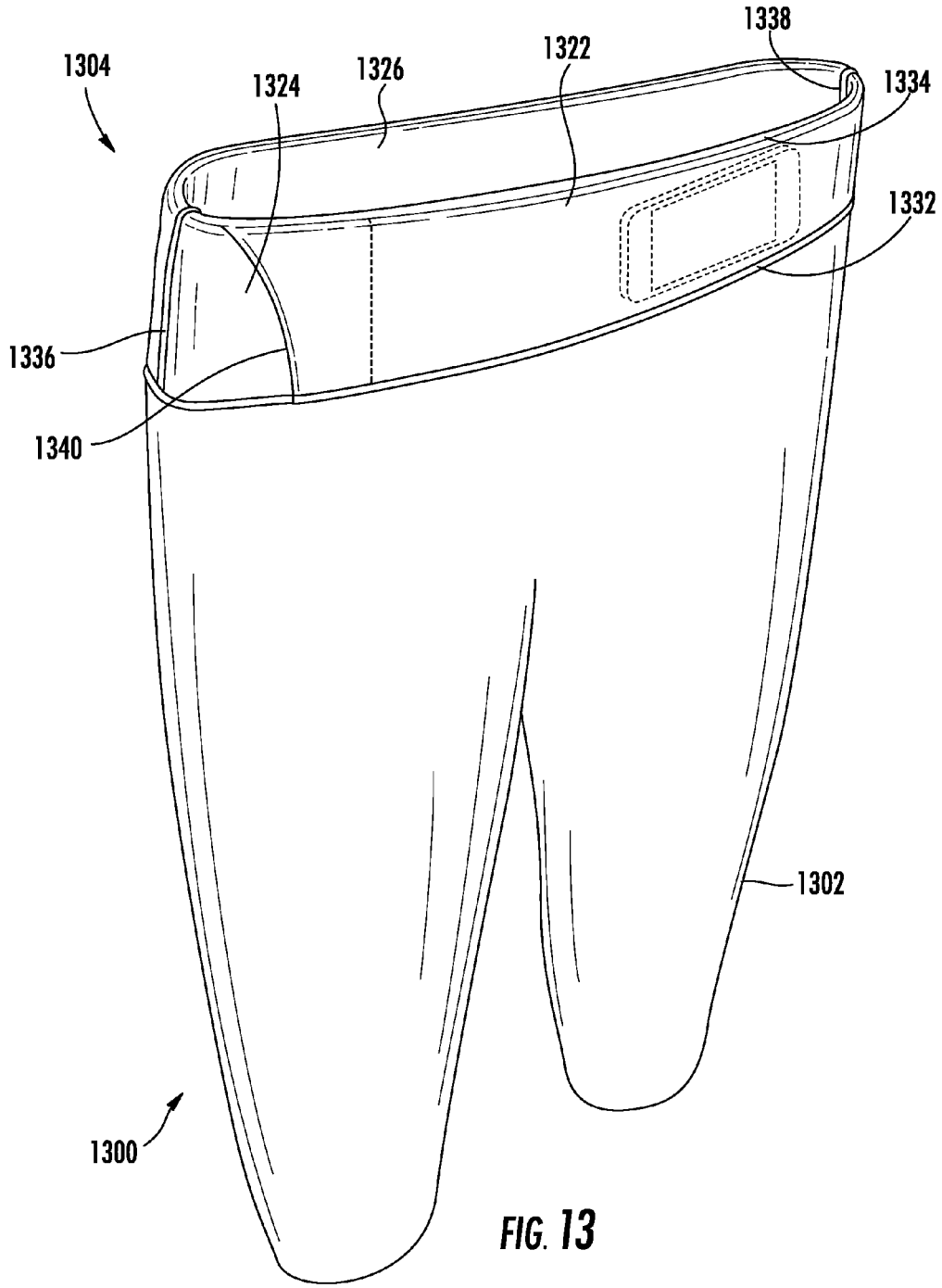
FIG. 13 is a schematic diagram of a garment with a front and back waistband pocket formed from four (and optionally six) pieces of material.

As shown in FIG. 13, embodiments of the invention include activewear 1300 with a waistband 1304 comprising multiple pieces of material. As shown, at least four pieces of material (e.g., six pieces of material) can be attached or sewn together at seams and attached to a body portion, such as legs or lower portion 1302, of the activewear. This embodiment comprises two outer pieces of fabric, which are elongated strips of material (one of which is shown by reference number 1322 and the other is in a similar position on the back of the garment) and two inner pieces of fabric (one of which is shown by reference number 1326 and the other is in a similar position on the back side of the front of the garment). A related embodiment includes two covering pieces of fabric (one of which is shown by reference number 1324, an edge of which is represented by a dotted line is disposed under and overlapped by fabric piece 1322). A view of the opposite side of the activewear (not shown) would show duplicate features in this arrangement. However, in the present view, the outer piece of fabric 1322 and covering piece of fabric 1324 of one side of the waistband are shown, and the inner piece of fabric 1326 on the opposite side of the waistband is shown. In embodiments, to form a pocket in each of the front and back portions of the waistband an outer piece of fabric is overlaid on top of an inner piece of fabric and sewn together at a bottom seam 1332 and at a top seam 1334. Optionally the fabric pieces can also be sewn together at side seam 1336/1338. In embodiments, each inner piece of fabric is longer than the outer piece of fabric, and one inner piece of fabric is sewn to an outer piece of fabric at a side seam 1336 and the other inner piece of fabric is sewn to the other outer piece of fabric at side seam 1338. Outer piece 1322 forms a pocket opening 1340 which may be curved or slanted relative to bottom seam 1332 and top seam 1334. Additionally, edge of pocket opening 1340 may be folded over and stitched to form a hem. The pocket openings may be configured so that their width is 100% the width of the waistband, or only a portion of the width of the waistband, such as 25%, 30%, 40%, 50%, 60%, 70%, 80%, or 90%, 95%, 96%, 97%, 98%, or 99% of the width of the waistband. Thus, four pieces of material form two pockets, a front pocket and back pocket each having a side opening for storage and access of items.

In embodiments, the inner piece of fabric may be the same material as the outer piece of fabric. In other embodiments, the inner piece of fabric may be a different material than the outer piece of fabric and may be aesthetically different as well. For example, the inner piece of fabric may be made of a more durable material such as a cotton/polyester blend to provide structural support of the waistband while the outer piece of fabric may be more visually appealing such as rayon. Thus, a portion of the inner piece of fabric not covered by outer piece being made from a different material may have a different visual presentation with respect to color, texture, or pattern than outer piece. In these later embodiments, a fifth and sixth piece of fabric (one of which is shown by reference number 1324) that serves as a front and back covering segment which is a segment of the same type of material as the outer piece of fabric may be used to overlay the portion of the inner piece of fabric that is exposed, thus presenting the same aesthetic look throughout the waistband. The covering segment 1324 can be a small polygonal strip of fabric at the front left of the waistband that extends from the side seam 1336 between the top seam 1334 and bottom seam 1332 under the pocket opening 1340 and partially under the outer piece of fabric 1322. In the back of the garment, if a second pocket is disposed in the back of the waistband the fabric pieces would be disposed in a similar manner. Thus, in this embodiment, the waistband is formed from six pieces of material. In embodiments in which inner piece of fabric is different than outer piece, covering segment ensures that the outside of the waistband has a uniform presentation.

In other embodiments, the six pieces of fabric can be combined into two pieces (one front and one back) such that one piece is run to the left and the other to the right in order to achieve a front and back pocket where the two pieces overlap, each with a pocket opening. This embodiment eliminates the side seams, but as it would be less structurally sound to hold the waistband in place it would require a piece of elastic or similar material to be added in order to keep the waistband in place. Additionally, this embodiment would also be more difficult to adjust the sizing or angle from the bottom of the waistband to the top.

Other embodiments of the waistband may comprise two pieces of material joined at a bottom seam and partially at a top seam to provide an annular pocket with openings at the top of the waistband. Other embodiments of the waistband may comprise four pieces of material, with two pieces forming a front portion of the waistband and two pieces forming a back portion, wherein the two pieces are joined at a bottom seam and partially at a top seam and at two side seams, thus forming a front pocket and back pocket with openings at the top of the waistband. In such embodiments, the opening to the one or more pockets can be provided along the seam itself, whereby only part of the material is sewn together leaving an opening in the seam to access the pocket.

Embodiments of the waistband can include a strip of elastic at the top of the waistband to accommodate users with different waist sizes. Additionally, or alternatively, all or a portion of the material comprising the waistband can be waterproof or water resistant to protect items inside the pockets. For example, each piece or multiple pieces of fabric of the waistband/pocket can be waterproof. In embodiments, non-waterproof fabric can be used to construct the waistband/pocket and an additional piece of waterproof material can be added as a layer to the waistband. The additional waterproof material can be placed either in between the fabric of the inner waistband and the outer waistband or on the outside of the waistband as an exterior surface of the waistband, whether facing the wearer of the garment or facing the public. Embodiments may include one or more small holes in the fabric of the waistband for plugging the wire leads of earphones or earbuds into a device held in the pocket so that an iPod or other music player may be stored in the pocket and played and listened to. The holes can be provided by multiple pieces of material joined together to provide access to the pocket.

Embodiments of the invention include a method for forming a waistband. In this embodiment the waistband is formed from 6 pieces: back inner piece of fabric (also known as inside back band), front inner piece of fabric (also known as inside front band), front outer piece of fabric (also known as outside front band), back outer piece of fabric (also known as outside back band), and fifth and sixth piece of fabric to serve as a front and back covering segment. First, each pocket covering front and back are overedge stitched. Then, a lockstitch hem is formed on the edge of the outer pieces of fabric (front and back) such that they have a ¼" seam double turned (clean finish). Then optionally, a size label is attached to the back inner piece of fabric and using a pressured heat seal machine. The heat seal is applied 25 seconds with paper attached and then 25 seconds without paper using a cotton cloth on top to avoid sticking to the machine. Then each side-seam of the inner pieces of fabric is serged, connecting them together. The seams are then stretched to check for any abnormal stitching and seam security.

When making the waistband, first the overedged back covering segment is attached to the hemmed front outer piece of fabric. Then the over-edged front covering segment is attached to the hemmed back outer piece of fabric. Starting at the side-seam of the back inner piece of fabric, the seam of the joined front covering segment/back outside band piece is matched and sewn using an over-edge machine. Sewing is continued, matching the edges of the waistband together and then is stopped approximately 5 inches from the second side seam of the inside waistband piece. At this point, the back covering segment/front outer piece of fabric is matched to the side seam of the front inner piece of fabric, overlapping the covering segment with the outer piece of fabric. Sewing is continued around the waistband until the sewn back covering segment piece is reached. The front outside waistband piece is then overlapped over the back covering segment and sewn overlapping the stitches at the side-seam of the waistband. Finally, the waistband is checked for quality.

When attaching to the pant, the waistband is turned to the right side of the fabric. The back outside waistband piece is then overlapped, matching it to the notch on the pocket and aligning the side seam of the waistband. The fabric is pinned at notch and the process of repeated on the front of the waistband. Pinning at the notch, the waistband is attached to the pant beginning at the back and aligning all notches to the seams of the pant. Finally, the garment is checked for quality issues.

In embodiments, the waistband is made of the same material or fabric as the lower portion of the activewear (such as the pants, shorts, etc.). In other embodiments, the waistband is made of a different material than the lower portion of the activewear. In other embodiments, a portion of the waistband is made of the same material as the lower portion of the activewear and a portion of the waistband is made of a different material than the lower portion of the activewear. For example, in some embodiments, the two outer pieces of fabric making up the waistband are the same material as the lower portion of the activewear and the two inner pieces are made of a different material. Further, the fifth and sixth piece of fabric which serve as covering segments may be the same material as the lower portion of the activewear. This presents a uniform appearance through the entire garment. In other embodiments, the two inner pieces of fabric making up the waistband are the same material as the lower portion of the activewear and the two outer pieces are made of a different material as well as the covering segments. This presents a look that highlights the waistband on the garment. In other embodiments, the material forming the waistband is entirely the same or entirely different than the lower portion of the activewear.

One of the many potential advantages of the present invention, only some of which are discussed in this specification, includes that the present invention provides a comfortable and secure way to carry items while exercising or moving from place to place (i.e., on the go), which does not restrict the user's range of motion. Another advantage of the present invention is to provide security of personal items from loss or theft while exercising by being able to contain the items on the person. Yet another advantage of the present invention includes easy access to the items in the concealed pocket within the activewear.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention in particular by combining the specified features of one embodiment with one or more features of another embodiment. It is intended that the specification and examples be considered as exemplary in nature and that variations that do not depart from the essence of the invention are intended to be within the scope of the invention.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown. It is therefore evident that the particular illustrative embodiments disclosed above may be altered or modified and all such variations are considered within the scope and spirit of the present invention. While embodiments are described in terms of "comprising," "containing," or "including" various components or steps, the embodiments can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or "from approximately a to b," or "from approximately a-b") disclosed herein is to be understood to set forth every number and range encompassed within the broader range of values. Also, the terms in the claims have their plain, ordinary meaning unless otherwise explicitly defined. Moreover, the indefinite articles "a" or "an," as used in the claims, are defined herein to mean one, at least one, or more than one of the element that it introduces.

The invention claimed is:

1. A garment comprising:

a body portion comprising fabric with an upper edge terminating as a 360° waistline;

a 360° waistband comprising at least four pieces of fabric;

wherein a first and second piece of fabric define a first pocket on the waistband and a third and fourth piece of fabric define a second pocket on the waistband;

wherein 360° of the waistline is attached to a bottom edge of the waistband;

wherein the first pocket and second pocket each comprise at least one opening to provide pocket access;

wherein the first and second piece of fabric defining the first pocket are of unequal lengths such that the second piece is longer than the first piece, and the third and fourth piece of fabric defining the second pocket are of unequal lengths such that the fourth piece is longer than the third piece;

wherein the second piece of fabric defines an inner layer of the first pocket and the first piece of fabric defines an outer layer of the first pocket, and the fourth piece of fabric defines an inner layer of the second pocket and the third piece defines an outer layer of the second pocket.

2. The garment of claim 1, wherein the first pocket is further defined by a top seam, bottom seam, and side seam, whereby the first and second pieces of fabric are joined at their respective top, bottom, and side edges, and wherein the second pocket is further defined by a top seam, bottom seam, and side seam, whereby the third and fourth pieces of fabric are joined at their respective top, bottom, and side edges.

3. A garment comprising:

a body portion comprising fabric with an upper edge terminating as a 360° waistline;

a 360° waistband comprising at least four pieces of fabric;

wherein a first and second piece of fabric define a first pocket on the waistband and a third and fourth piece of fabric define a second pocket on the waistband;

wherein 360° of the waistline is attached to a bottom edge of the waistband;

wherein the first pocket and second pocket each comprise at least one opening to provide pocket access;

wherein the second piece of fabric comprises a portion that extends beyond the first piece of fabric and the fourth piece of fabric comprises a portion that extends beyond the third piece of fabric;

further comprising a fifth and sixth piece of fabric, wherein the fifth piece of fabric is disposed over the portion of the second piece of fabric that extends beyond the first piece of fabric, and the sixth piece of fabric is disposed over the portion of the fourth piece of fabric that extends beyond the third piece of fabric.

4. The garment of claim 3, wherein the fifth piece of fabric is disposed under the first piece of fabric and the sixth piece of fabric is disposed under the third piece of fabric.

5. The garment of claim 3, wherein the fifth piece of fabric is a different type of fabric than the first piece of fabric and wherein the sixth piece of fabric is a different type of fabric than the third piece of fabric.

6. A garment comprising:

a body portion made of fabric having a top edge defining a 360° waistline;

a waistband comprising at least four pieces of material including a first and second piece and a third and fourth piece, wherein the first and second piece are attached on three sides forming a first pocket and the third and fourth piece are attached on three sides forming a second pocket;

wherein the bottom of the waistband is attached to the top of the body portion along 360° of the waistline, and the waistband and the body portion are each disposed on opposing sides of the waistline;

wherein the first and second pockets are capable of holding items and each of the first and second pockets comprises one or more pocket openings to provide access;

wherein the second piece is longer than the first piece and the fourth piece is longer than the third piece, and the second piece defines an inner layer of the first pocket and first piece defines an outer layer of the first pocket, and the fourth piece defines an inner layer of the second pocket and third piece defines an outer layer of the second pocket.

7. The garment of claim 6, wherein the second piece and fourth piece are attached at two seams forming a 360° inner layer.

8. The garment of claim 6, wherein a portion of the second piece is not covered by the first piece and a portion of the fourth piece is not covered by the third piece.

9. The garment of claim 8, further comprising a fifth piece covering the portion of the second piece not covered by the first piece and a sixth piece covering the portion of the fourth piece not covered by the third piece.

10. A waistband comprising:

at least four pieces of fabric;

wherein a first and second piece of fabric define a first pocket on the waistband and a third and fourth piece of fabric define a second pocket on the waistband;

wherein the second piece of fabric is attached to the fourth piece of fabric in such a manner as to provide for a 360 degree waistband;

wherein the second piece of fabric is longer than the first piece of fabric and the first and second pieces of fabric are attached such that a portion of the second piece of fabric extends beyond the first piece of fabric;

wherein the fourth piece is longer than the third piece of fabric and the third and fourth pieces of fabric are attached such that a portion of the fourth piece of fabric extends beyond the third piece of fabric;

wherein the first pocket and second pocket each comprise at least one opening to provide pocket access; and further comprising two additional pieces of fabric, wherein a fifth piece of fabric is disposed over the portion of the second piece of fabric that extends beyond the first piece of fabric;

wherein a sixth piece of fabric is disposed over the portion of the fourth piece of fabric that extends beyond the third piece of fabric.

11. The waistband of claim 10, wherein the fifth piece of fabric is disposed under the first piece of fabric and the sixth piece of fabric is disposed under the third piece of fabric.

12. A method of manufacturing a waistband, comprising:

providing a first, second, third, fourth, fifth, and sixth piece of fabric;

attaching the second and fourth pieces of fabric together to form an inner waistband loop with a first side seam and a second side seam;

attaching the first and sixth pieces of fabric together to form a first outer waistband portion with a first outer waistband seam, overlaying the first outer waistband seam with the first side seam of the inner waistband loop, and attaching the first outer waistband portion to the inner waistband loop; and attaching the third and fifth pieces of fabric together to form a second outer waistband portion with a second outer waistband seam, overlaying the second outer waistband seam with the second side seam of the inner waistband loop, and attaching the second outer waistband portion to the inner waistband loop.

* * * * *